US011781815B2

(12) United States Patent
Alexander et al.

(10) Patent No.: US 11,781,815 B2
(45) Date of Patent: Oct. 10, 2023

(54) LIGHTWEIGHT STRUCTURALLY AND THERMALLY EFFICIENT OSCILLATING HEAT PIPE PANEL

(71) Applicant: ThermAvant Technologies, LLC, Columbia, MO (US)

(72) Inventors: Benjamin Alexander, Columbia, MO (US); Daniel Pounds, Columbia, MO (US); Joshua Schorp, St. Charles, MO (US); Bruce Drolen, Altadena, CA (US); Corey Wilson, San Francisco, CA (US); Joseph Boswell, San Francisco, CA (US)

(73) Assignee: ThermAvant Technologies, LLC, Columbia, MO (US)

( * ) Notice: Subject to any disclaimer, the term of this patent is extended or adjusted under 35 U.S.C. 154(b) by 349 days.

(21) Appl. No.: 17/014,681

(22) Filed: Sep. 8, 2020

(65) Prior Publication Data

US 2022/0074674 A1 Mar. 10, 2022

(51) Int. Cl.
*F28D 15/04* (2006.01)
*F28D 15/02* (2006.01)

(52) U.S. Cl.
CPC ..... *F28D 15/04* (2013.01); *F28D 15/0208* (2013.01)

(58) Field of Classification Search
CPC .... F28D 15/04; F28D 15/0208; F28D 15/043; F28D 15/046; F28D 2015/0216; F28D 15/0266; F28D 15/0275
USPC ..... 165/104.26, 104.19
See application file for complete search history.

(56) References Cited

U.S. PATENT DOCUMENTS 6,233,944 B1 * 5/2001 Yamada ..... H10N 10/17 62/3.7
7,958,934 B2 * 6/2011 Nara ..... F28F 3/12 165/80.4
2010/0181593 A1 * 7/2010 Lee ..... F28D 15/0275 257/E33.059
2019/0315500 A1 * 10/2019 Duong ..... B64G 1/506
2019/0315501 A1 * 10/2019 Duong ..... B64G 1/503

OTHER PUBLICATIONS

Handekar et al.; Embedded Pulsating Heat Pipe Radiators; 14th International Heat Pipe Conference (14th IHPC), Florianopólis, Brazil, Apr. 22-27, 2007; pp. 1-6.

(Continued)

*Primary Examiner* — Justin M Jonaitis
(74) *Attorney, Agent, or Firm* — Sandberg Phoenix & von Gontard PC

(57) ABSTRACT

A heat rejection panel that comprises a chassis having a first side, an opposing second side, and an aperture extending therethrough. The panel additionally comprises at least one oscillating heat pipe (OHP) plate disposed over a portion of the first side and/or the second side of the chassis. Each OHP plate includes a first face, an opposing second face, and a plurality of internal OHP channels. A portion of the first face and/or second face of each OHP plate is accessible for thermal interfacing with a heat source. A portion of the second face of each OHP plate is accessible for thermal interfacing with a heat sink. Each OHP plate will remove heat from the heat source, spread the removed heat throughout each OHP plate to provide an isothermal OHP plate, and reject the heat to the heat sink.

22 Claims, 8 Drawing Sheets

(56) References Cited

OTHER PUBLICATIONS

Hemadri et al.; Thermal Radiators With Embedded Pulsating Heat Pipes: Infra-Red Thermography and Simulations; Elsevier; Applied Thermal Engineering; vol. 31; Issues 6-7; May 2011; pp. 1332-1346.

* cited by examiner

LIGHTWEIGHT STRUCTURALLY AND THERMALLY EFFICIENT OSCILLATING HEAT PIPE PANEL

GOVERNMENT RIGHTS

This invention was made with government support under contract 80NSSC18P2182 awarded by NASA. The government has certain rights in the invention.

FIELD

The present teachings relate to panels, particularly oscillating heat pipe panels, for collecting and spreading heat over an area to enable heat rejection via radiation and/or convection

BACKGROUND

The statements in this section merely provide background information related to the present disclosure and may not constitute prior art.

In many known instances, a heat source such as electrical components, computer modules, batteries, etc., are disposed on or near a structure such as a housing, panel, plate, wall or partition that impedes the rejection of heat from the heat source. Particularly, in various instances, the structure can have low thermal conductivity such that in order to adequately cool the heat source and maintain its temperature within a desired operation range, the heat must be absorbed/removed and transferred though the structure such that the heat can be rejected on the other side of the structure. However, it is often difficult to efficiently thermally couple a heat source located on one side of a structure to a heat rejection device located on the other side of the structure. For example, spacecraft radiator panels, having one or more heat generating source disposed on or near an interior side of the panels (relative to the spacecraft), are constructed of a lightweight, low thermally conductive honeycomb material. Such radiator panels have very poor through-panel thermal conductivity.

In some known instances, to construct large scale radiator panels (e.g., radiator panels having dimensions measured in inches or centimeters to dimensions measured in feet or meters) that meet mass and structural requirements, constant conductance heat pipes (CCHPs) are embedded in a lightweight honeycomb core of the panel with thin face sheets on either side. These panels have high thermal conductance along the CCHPs, but low thermal conductance through the panel between the CCHPs and across the surfaces of the panel perpendicular to the CCHPs. The low through-panel thermal conductance is particularly problematic because the heat sources are often located on the opposite side of the panel (e.g., the inside or interior side) from the side of the panel where the heat needs to be rejected (e.g., the outside or exterior side). As a result, such radiator panels suffer from large thermal gradients between the heat source and the rejection surface and from non-uniformities in heat rejection across the rejection surface, which can lead to decreased efficiency in heat removal from the heat source.

SUMMARY

The primary objective of the present disclosure is to provide a heat removal structure (e.g., a housing, panel, plate, wall or partition, etc.) structured and operable to collect heat from a heat source and efficiently and evenly spread the heat over substantially an entire rejection surface of the structure. For example, in various embodiments, the present disclosure provides systems and method for collecting heat from a heat source and spreading heat over a rejection surface or area to enable heat rejection via radiation, convection, etc. More particularly, in various embodiments, the present disclosure provides systems and methods for achieving an isothermal heat rejection surface (e.g., an isothermal heat rejection panel) that removes heat from a heat source very efficiently and reliably. The heat rejection surface/panel can be fabricated to meet generally any desired size requirements ranging from large (having dimensions measured in feet or meters) to small (having dimensions measured in inches or centimeters).

In various embodiments, the present disclosure provides a heat rejection panel that comprises a chassis having a first side, an opposing second side, and an aperture extending therethrough. The panel additionally comprises at least one oscillating heat pipe (OHP) plate disposed over a portion of the first side and/or the second side of the chassis. Each OHP plate includes a first face, an opposing second face, and a plurality of internal OHP channels. A portion of the first face and/or second face of each OHP plate is accessible for thermal interfacing with a heat source. A portion of the second face of each OHP plate is accessible for thermal interfacing with a heat sink. Each OHP plate will remove heat from the heat source, spread the removed heat throughout each OHP plate to provide an isothermal OHP plate, and reject the heat to the heat sink.

In various other embodiments, the present disclosure provides a structure having an outermost wall that defines an interior space of the structure and separates the interior space from an ambient environment surrounding the structure, wherein at least a portion of the outermost wall comprises at least one heat rejection panel. Each heat rejection panel comprises a chassis having a first side facing toward the interior of the structure, an opposing second side facing toward the ambient environment, and at least one aperture extending therethrough. Each heat rejection panel additionally comprises at least one oscillating heat pipe (OHP) plate disposed over at least a portion of at least one of the first side and the second side of the chassis. The at least one OHP plate comprises a first face, an opposing second face, and a plurality of internal OHP channels. At least one portion of at least one of the first face and the second face of the at least one OHP plate is accessible for thermal interfacing with at least one heat source disposed within the interior of the structure. At least one portion of the second face of the at least one OHP plate is accessible for thermal interfacing with the ambient environment such that the at least one OHP plate will remove heat from the heat source, spread the removed heat throughout the at least one OHP plate to provide an isothermal OHP plate, and reject the heat to the ambient environment.

This summary is provided merely for purposes of summarizing various example embodiments of the present disclosure so as to provide a basic understanding of various aspects of the teachings herein. Various embodiments, aspects, and advantages will become apparent from the following detailed description taken in conjunction with the accompanying drawings which illustrate, by way of example, the principles of the described embodiments. Accordingly, it should be understood that the description and specific examples set forth herein are intended for purposes of illustration only and are not intended to limit the scope of the present teachings.

DRAWINGS

The drawings described herein are for illustration purposes only and are not intended to limit the scope of the present teachings in any way.

Figure 4:
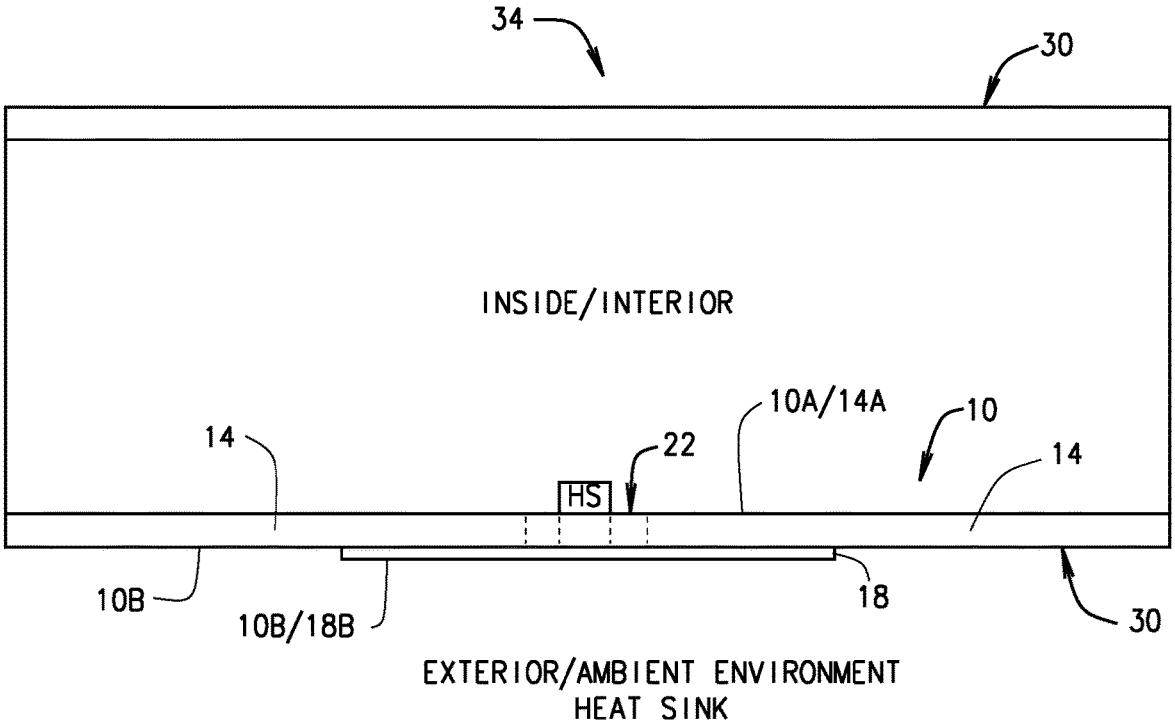
FIG. 4 is an exemplary block diagram of a structure comprising the heat rejection panel shown in FIG. 1, in accordance with all the embodiments of the present disclosure.
Figure 5A:
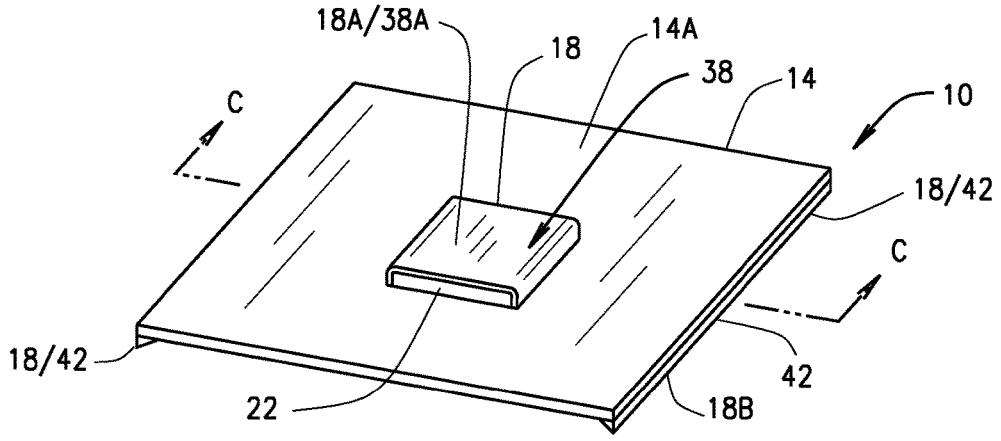
FIG. 5A is an isometric view of the heat rejection panel shown in FIGS. 1 through 4, in accordance with various embodiments of the present disclosure.
Figure 5B:
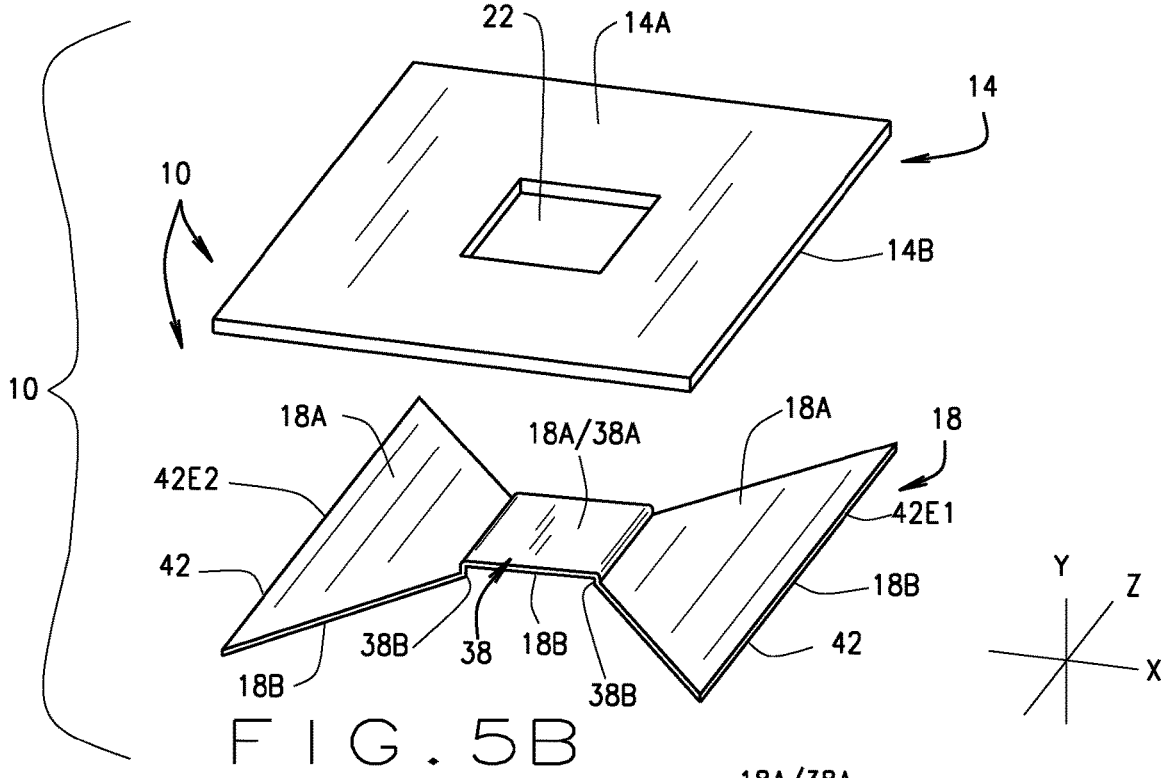
FIG. 5B is an isometric exploded view of the heat rejection panel shown in FIG. 5A, in accordance with various embodiments of the preset disclosure.
Figure 5C:
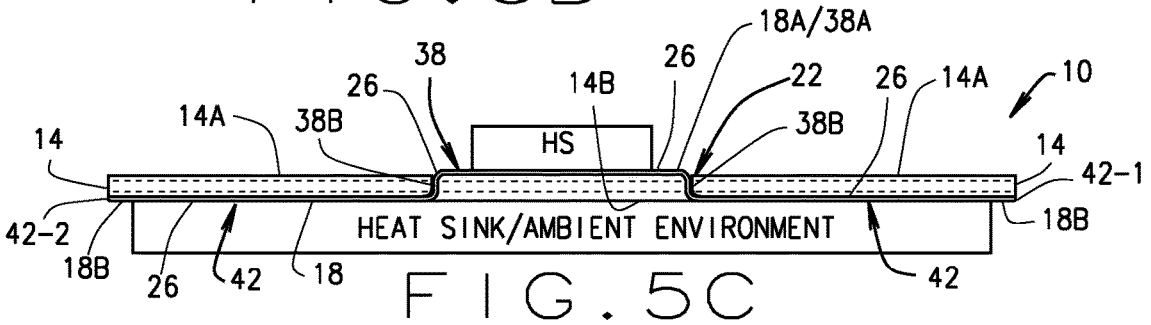
FIG. 5C is cross-sectional view of the heat rejection panel shown in FIGS. 5A and 5B along line C-C, in accordance with various embodiments of the present disclosure.
Figure 6A:
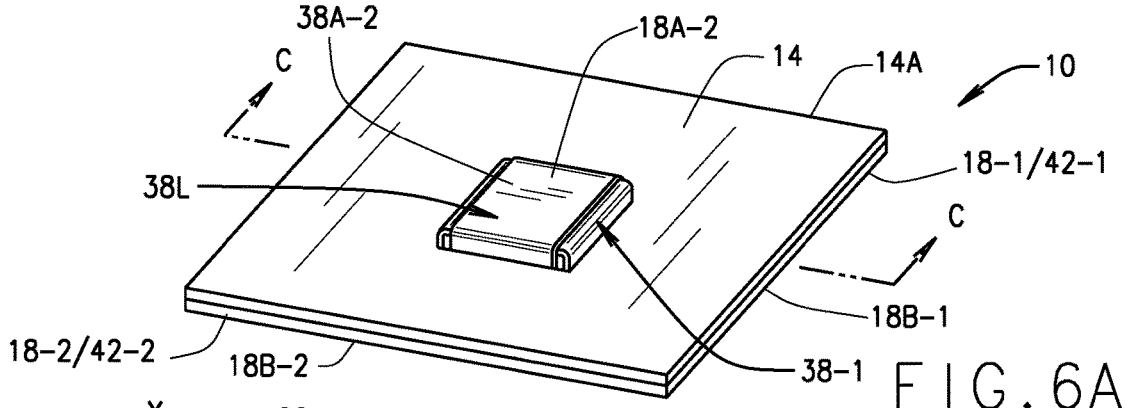
Figure 6B:
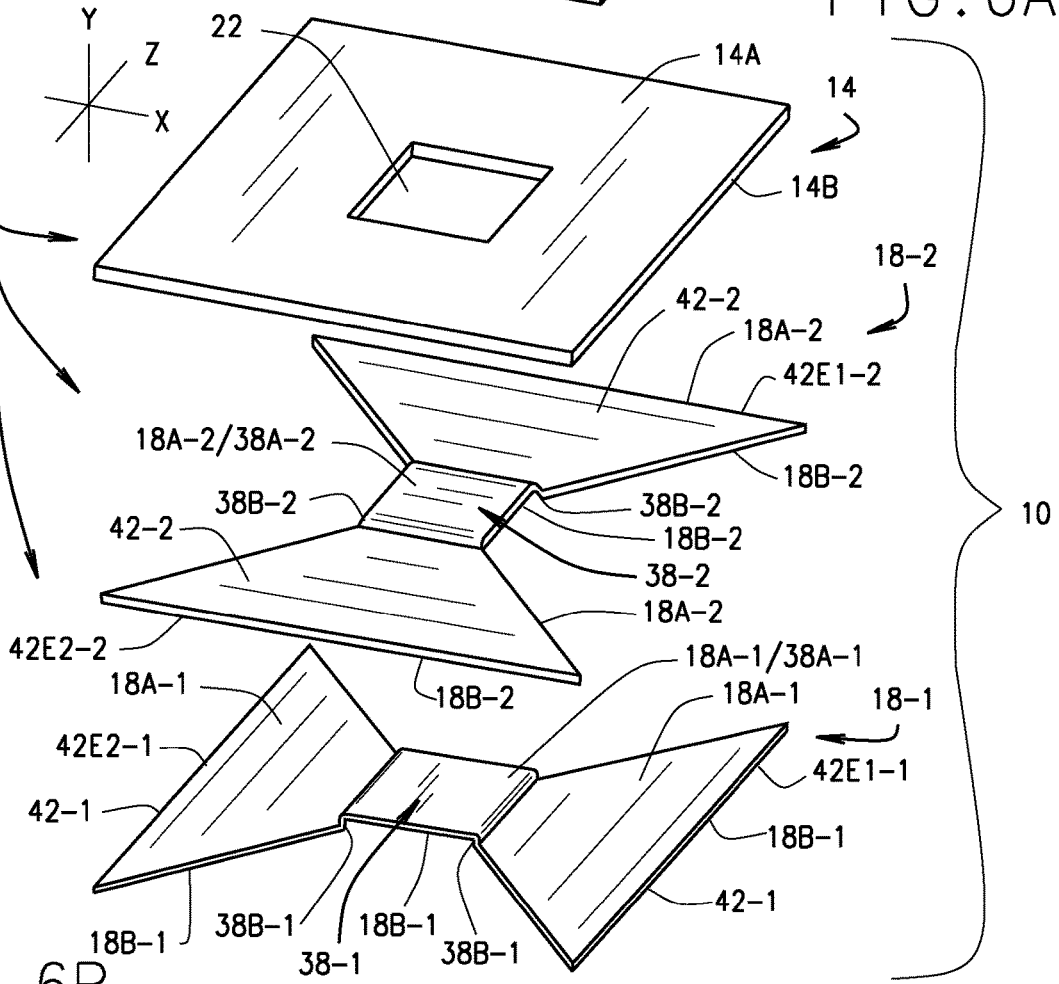

FIG. 6A is an isometric view of the heat rejection panel shown in FIGS. 1 through 4, in accordance with various other embodiments of the present disclosure FIG. 6B is an isometric exploded view of the heat rejection panel shown in FIG. 6A, in accordance with various embodiments of the preset disclosure FIG. 5C is cross-sectional view of the heat rejection panel shown in FIGS. 6A and 6B along line C-C, in accordance with various embodiments of the present disclosure.

Figure 7A:
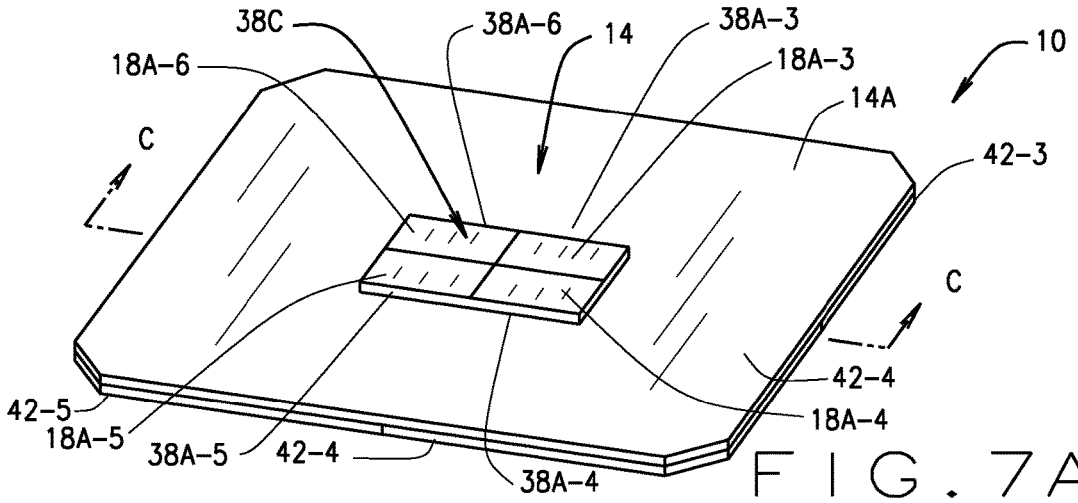
Figure 7B:
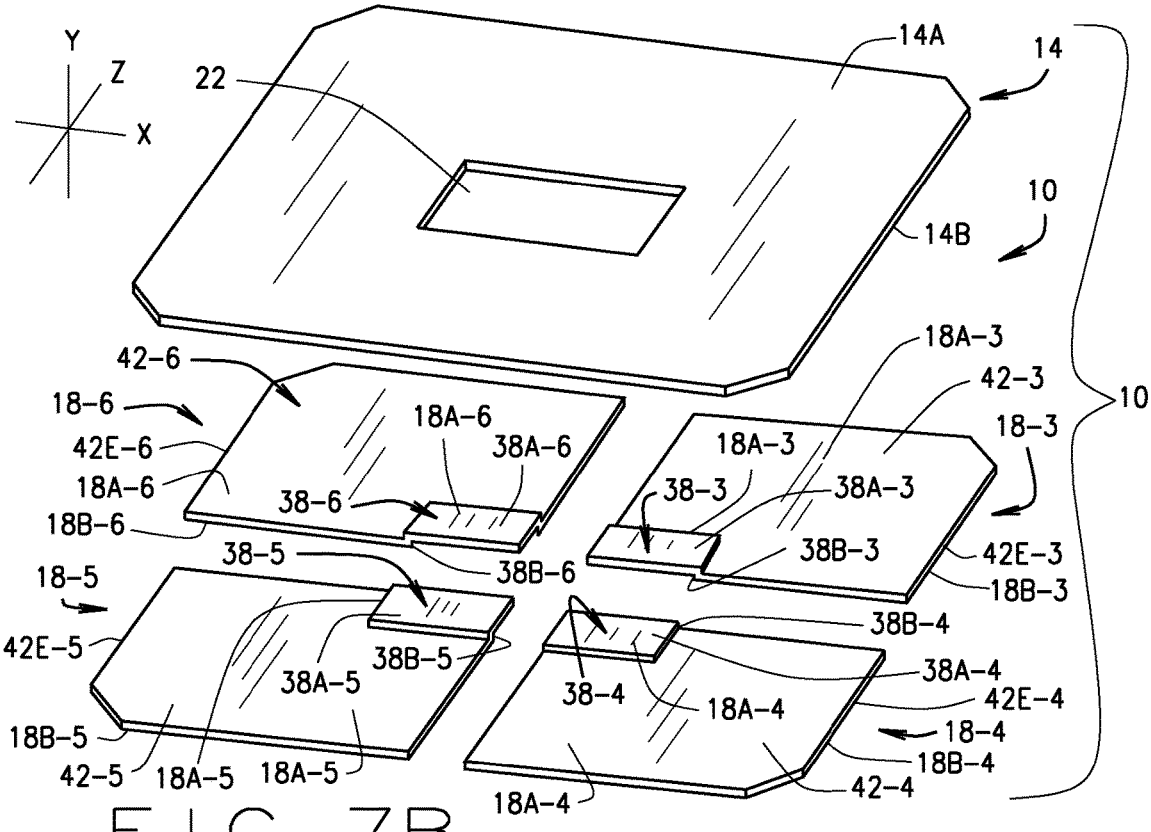
Figure 7C:
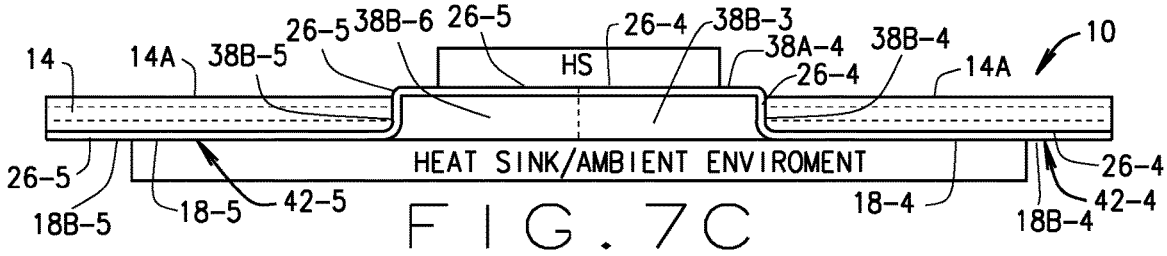

FIG. 7A is an isometric view of the heat rejection panel shown in FIGS. 1 through 4, in accordance with yet other various embodiments of the present disclosure FIG. 7B is an isometric exploded view of the heat rejection panel shown in FIG. 7A, in accordance with various embodiments of the preset disclosure FIG. 7C is cross-sectional view of the heat rejection panel shown in FIGS. 7A and 7B along line C-C, in accordance with various embodiments of the present disclosure.

Figure 8A:
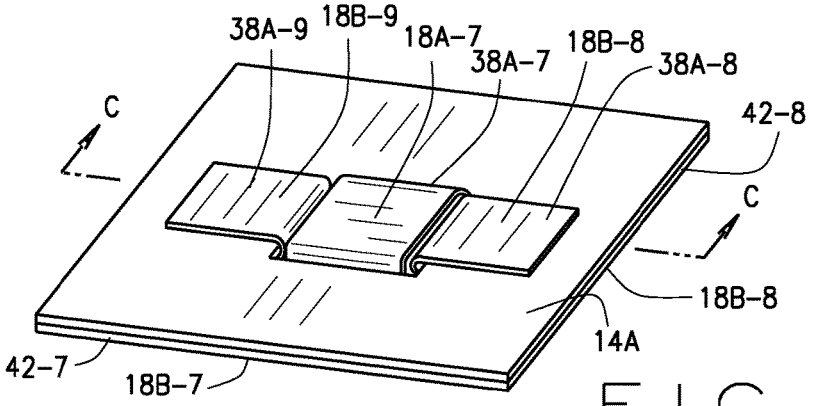
Figure 8B:
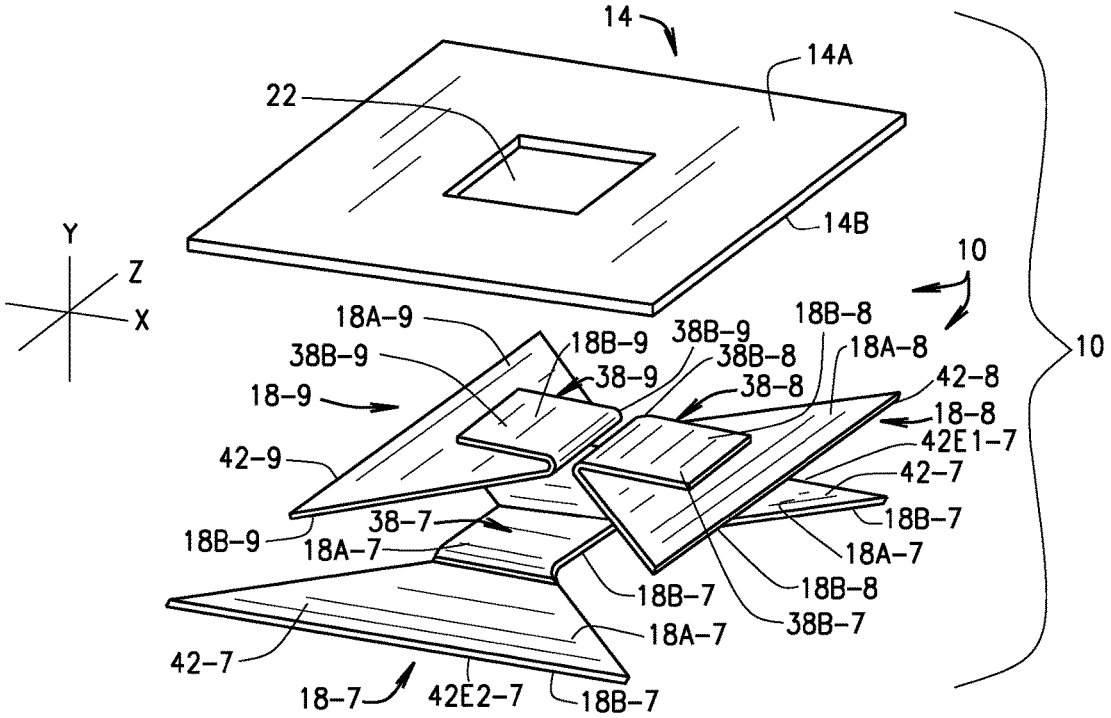
Figure 8C:
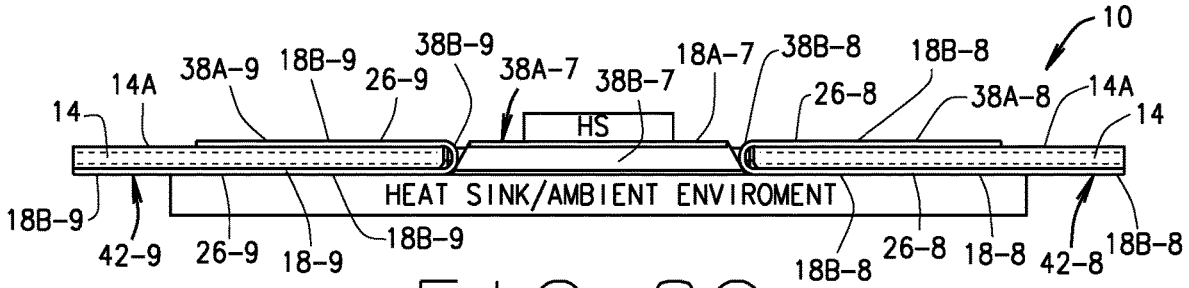

FIG. 8A is an isometric view of the heat rejection panel shown in FIGS. 1 through 4, in accordance with various embodiments of the present disclosure FIG. 8B is an isometric exploded view of the heat rejection panel shown in FIG. 8A, in accordance with still yet other various embodiments of the preset disclosure FIG. 8C is cross-sectional view of the heat rejection panel shown in FIGS. 8A and 8B along line C-C, in accordance with various embodiments of the present disclosure.

Figure 9A:
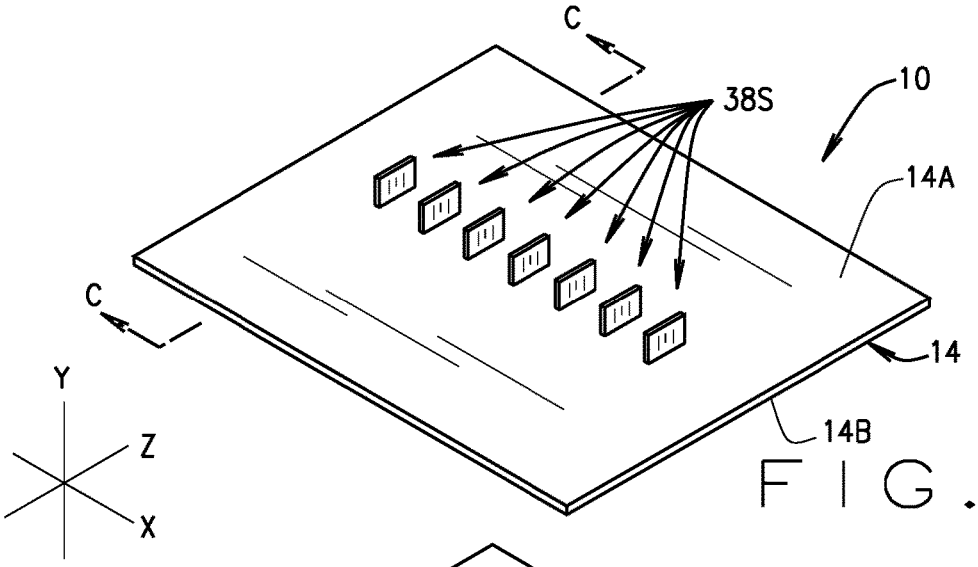
Figure 9B:
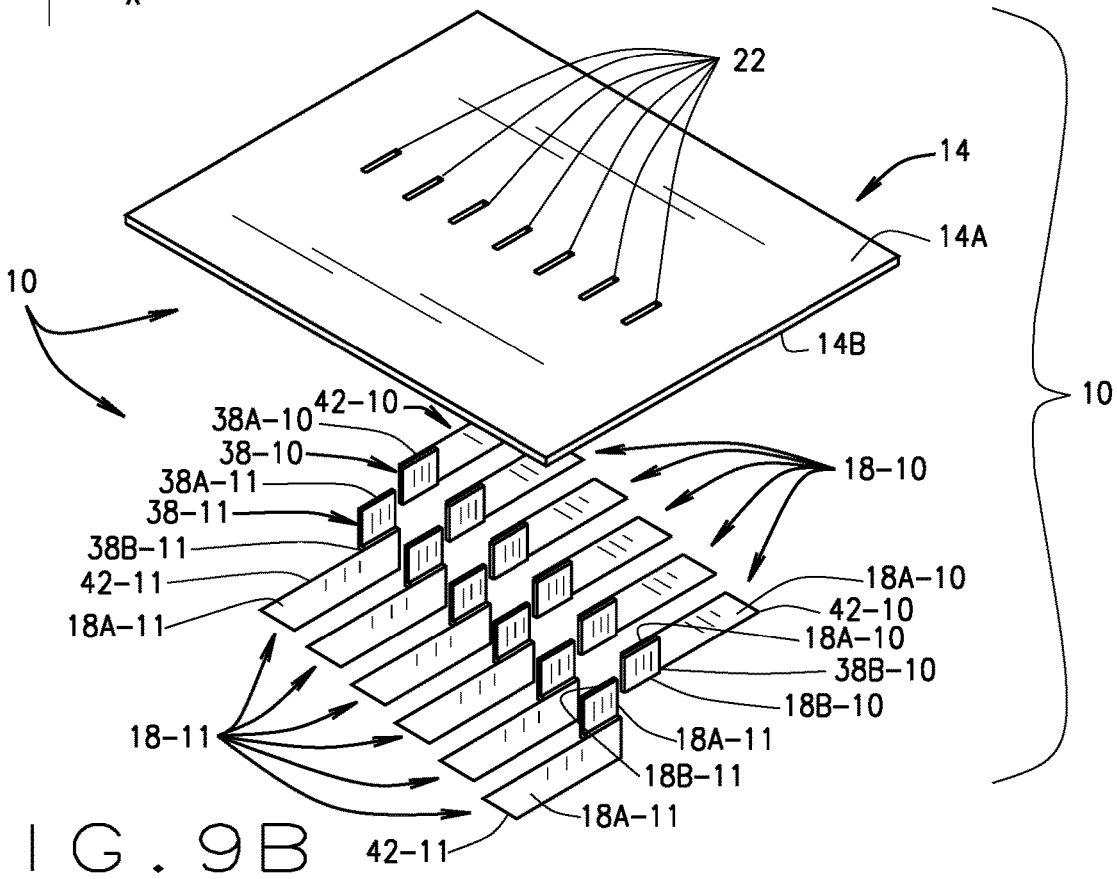
Figure 9C:
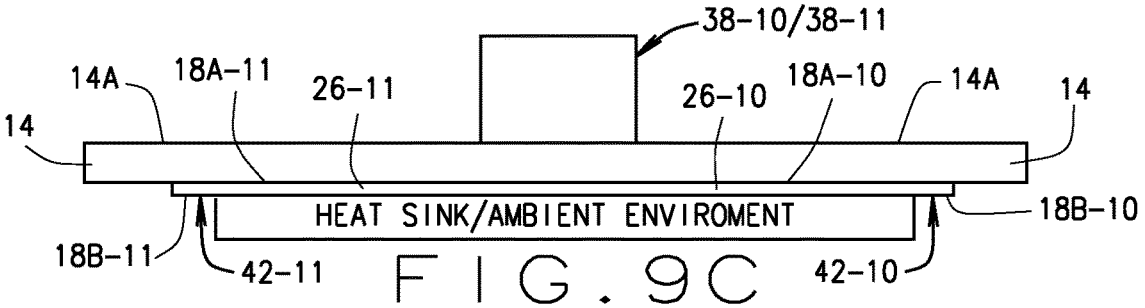

FIG. 9A is an isometric view of the heat rejection panel shown in FIGS. 1 through 4, in accordance with yet other various embodiments of the present disclosure FIG. 9B is an isometric exploded view of the heat rejection panel shown in FIG. 9A, in accordance with various embodiments of the preset disclosure FIG. 9C is cross-sectional view of the heat rejection panel shown in FIGS. 9A and 9B along line C-C, in accordance with various embodiments of the present disclosure.

Figure 10:
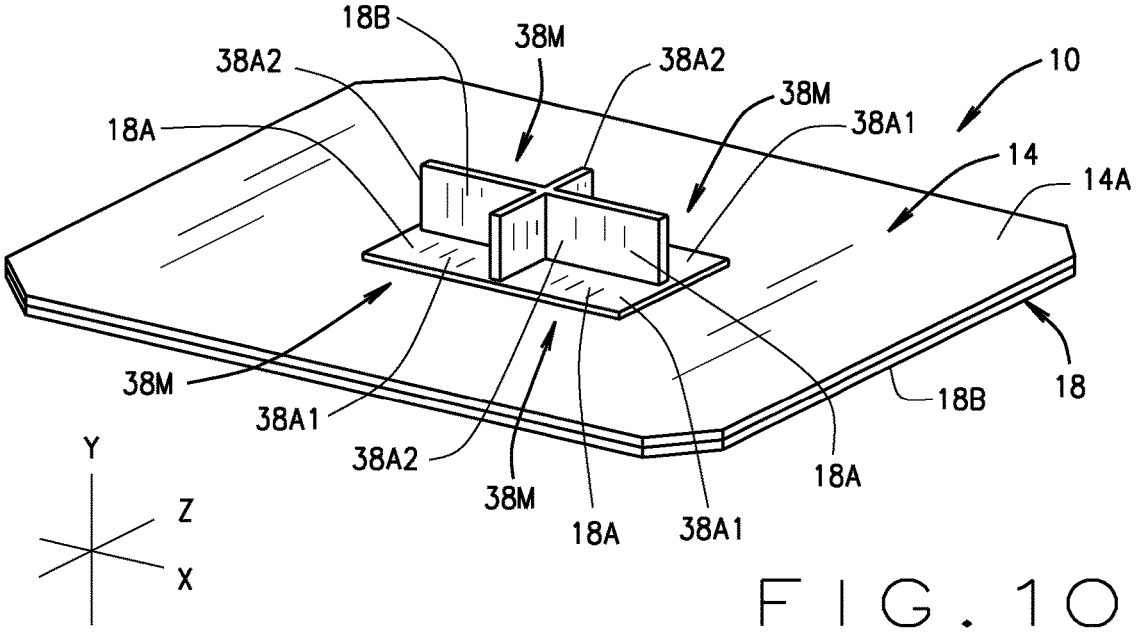

FIG. 10 is an isometric view of the heat rejection panel shown in FIGS. 1 through 9C comprising multi-base heat source platforms, in accordance with various embodiments of the present disclosure.

Figure 11:
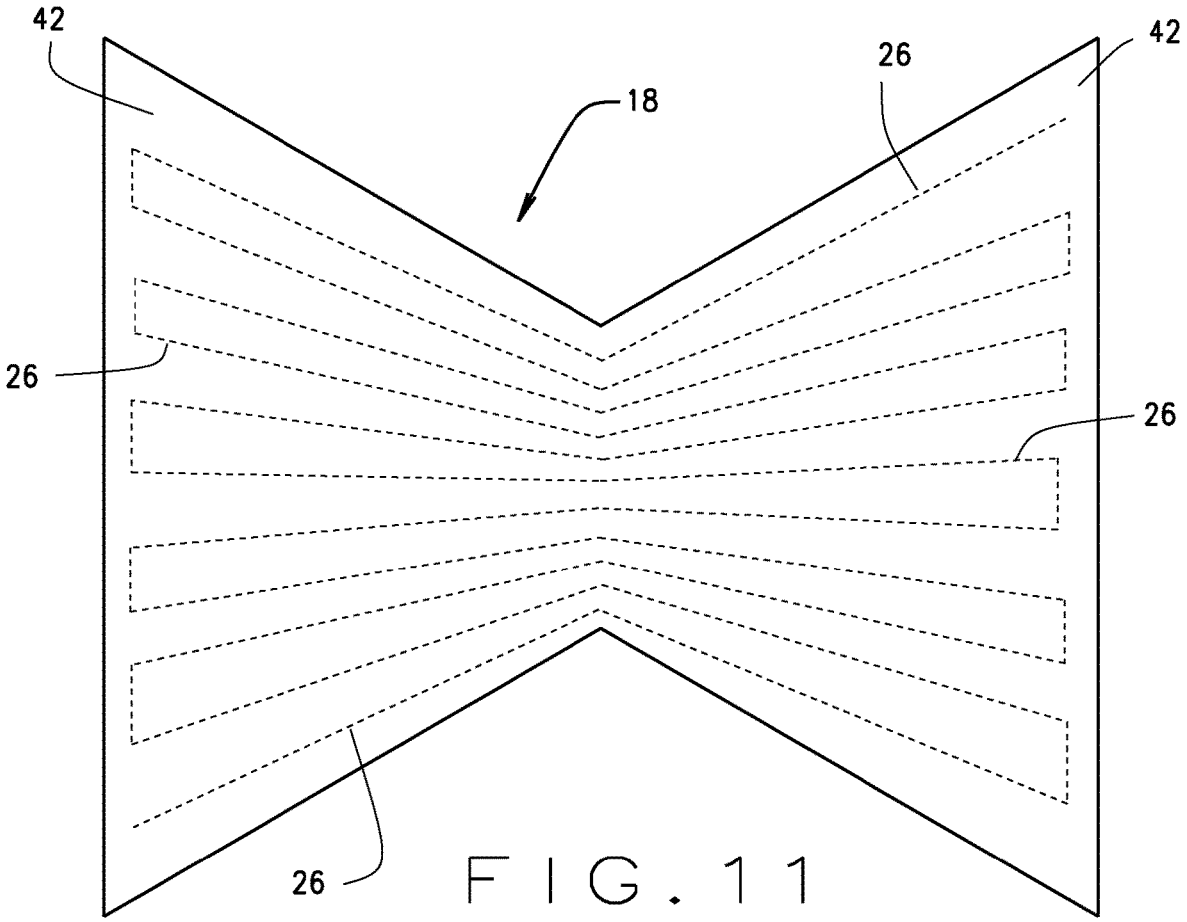

FIG. 11 is an exemplary top view an OHP plate having wings in the shape of a truncated triangle, wherein the internal channels within the wings have a divergent, or fan-like, pattern, in accordance with various embodiments of the present disclosure.

Corresponding reference numerals indicate corresponding parts throughout the several views of drawings.

DETAILED DESCRIPTION

The following description is merely exemplary in nature and is in no way intended to limit the present teachings, application, or uses. Throughout this specification, like reference numerals will be used to refer to like elements. Additionally, the embodiments disclosed below are not intended to be exhaustive or to limit the invention to the precise forms disclosed in the following detailed description. Rather, the embodiments are chosen and described so that others skilled in the art can utilize their teachings. As well, it should be understood that the drawings are intended to illustrate and plainly disclose presently envisioned embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims.

Unless otherwise defined, all technical and scientific terms used herein have the same meaning as commonly understood by one of ordinary skill in the art to which this disclosure belongs. The terminology used herein is for the purpose of describing particular example embodiments only and is not intended to be limiting. As used herein, the singular forms "a", "an", and "the" may be intended to include the plural forms as well, unless the context clearly indicates otherwise. The terms "comprises", "comprising", "including", and "having" are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps can be employed.

When an element, object, device, apparatus, component, region or section, etc., is referred to as being "on", "engaged to or with", "connected to or with", or "coupled to or with" another element, object, device, apparatus, component, region or section, etc., it can be directly on, engaged, connected or coupled to or with the other element, object, device, apparatus, component, region or section, etc., or intervening elements, objects, devices, apparatuses, components, regions or sections, etc., can be present. In contrast, when an element, object, device, apparatus, component, region or section, etc., is referred to as being "directly on", "directly engaged to", "directly connected to", or "directly coupled to" another element, object, device, apparatus, component, region or section, etc., there may be no intervening elements, objects, devices, apparatuses, components, regions or sections, etc., present. Other words used to describe the relationship between elements, objects, devices, apparatuses, components, regions or sections, etc., should be interpreted in a like fashion (e.g., "between" versus "directly between", "adjacent" versus "directly adjacent", etc.).

As used herein the phrase "operably connected to" will be understood to mean two are more elements, objects, devices, apparatuses, components, etc., that are directly or indirectly connected to each other in an operational and/or cooperative manner such that operation or function of at least one of the elements, objects, devices, apparatuses, components, etc., imparts are causes operation or function of at least one other of the elements, objects, devices, apparatuses, components, etc. Such imparting or causing of operation or function can be unilateral or bilateral.

As used herein, the term "and/or" includes any and all combinations of one or more of the associated listed items. For example, A and/or B includes A alone, or B alone, or both A and B.

Although the terms first, second, third, etc. can be used herein to describe various elements, objects, devices, apparatuses, components, regions or sections, etc., these elements, objects, devices, apparatuses, components, regions or sections, etc., should not be limited by these terms. These terms may be used only to distinguish one element, object, device, apparatus, component, region or section, etc., from another element, object, device, apparatus, component, region or section, etc., and do not necessarily imply a sequence or order unless clearly indicated by the context.

Moreover, it will be understood that various directions such as "upper", "lower", "bottom", "top", "left", "right", "first", "second" and so forth are made only with respect to explanation in conjunction with the drawings, and that components may be oriented differently, for instance, during transportation and manufacturing as well as operation. Because many varying and different embodiments may be made within the scope of the concept(s) taught herein, and because many modifications may be made in the embodiments described herein, it is to be understood that the details herein are to be interpreted as illustrative and non-limiting.

Figure 1:
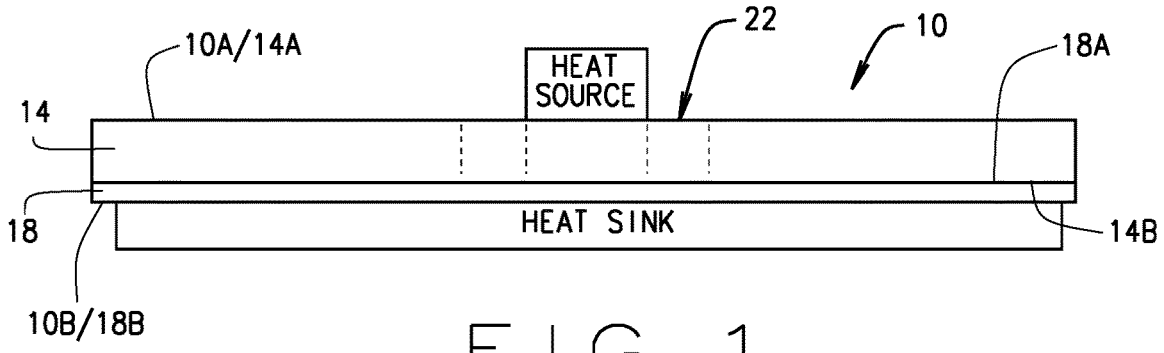
FIG. 1 is an exemplary block diagram of a heat rejection panel, in accordance with all the embodiments of the present disclosure.

Referring to FIG. 1, the present disclosure provides a heat rejection panel 10 that is generally structured and operable to: 1) absorb/remove heat from one or more heat source disposed on or adjacent one side of the panel 10; 2) spread the heat over a surface of the panel to establish an isothermal heat rejection surface; and 3) via the isothermal heat rejection surface, reject/dissipate the heat to a heat sink disposed on an opposing side of the panel 10, thereby efficiently cooling the heat source(s). The heat sink can be any system, device or environment capable of absorbing and dissipating the heat rejected from the isothermal heat rejection surface. As described further below, in various embodiments, the heat sink is the ambient environment surrounding an exterior side of the panel 10. The heat source(s) can be any component, device, system, mechanism or apparatus that generates heat. For example, in various embodiments the heat source(s) can be one or more computer device, component, chip, circuit board, or other electronic device. The panel 10 can be a stand-alone structure or be a panel, wall, housing, partition, outer body or any other structure, part or component of any purposed structure. As used herein, a purposed structure will be understood to be any structure constructed for an operable purpose such as any device, mechanism, apparatus, system, building, box, cabinet, housing, vehicle, aircraft, spacecraft, etc.

Figure 2:
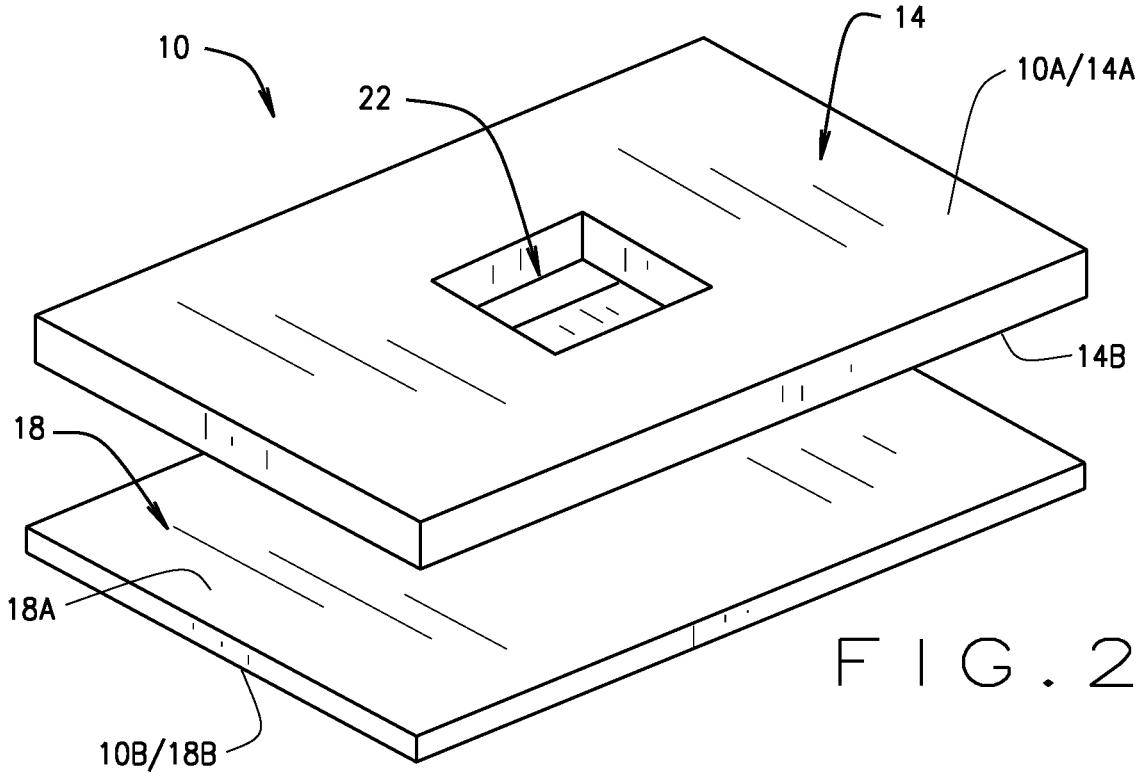
FIG. 2 is an isometric exploded view of the block diagram shown in FIG. 1, in accordance with all the embodiments of the present disclosure.
Figure 3:
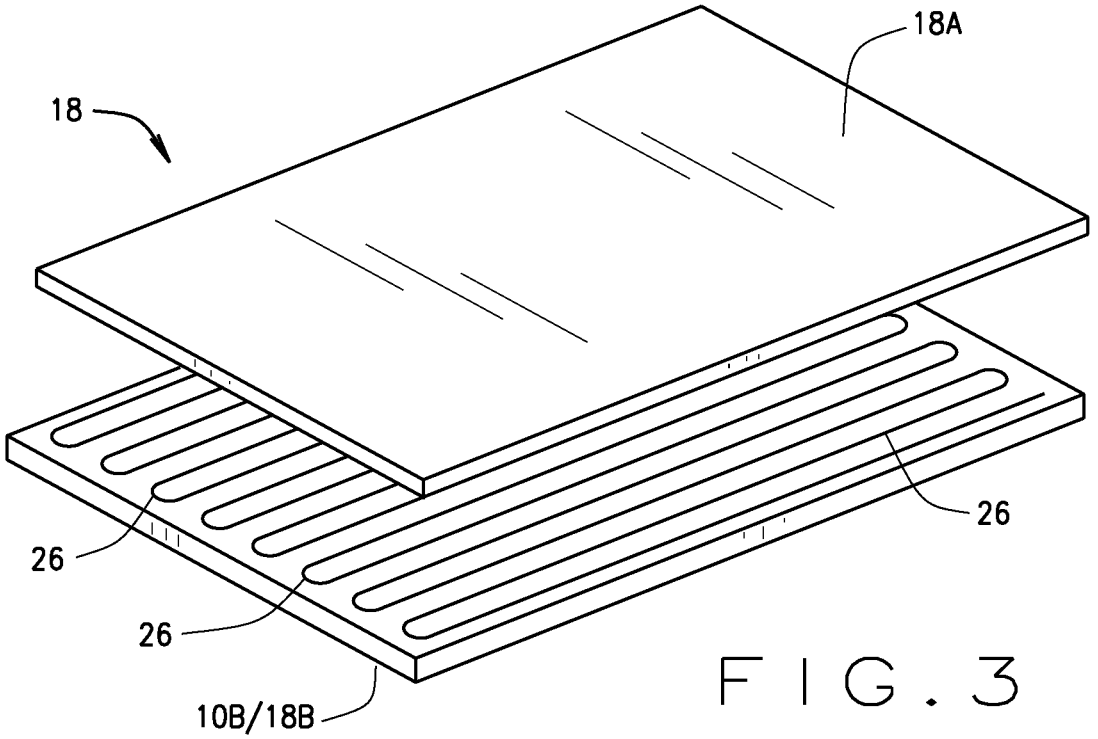
FIG. 3 is an isometric view of an oscillating heat pipe (OHP) plate of the heat rejection panel, wherein the OHP plate is exemplarily sectioned to show a plurality of internal OHP channels formed internally therein, in accordance with all the embodiments of the present disclosure.

Referring now to FIGS. 1, 2 and 3, the heat rejection panel 10 generally comprises a chassis 14 and at least one oscillating heat pipe (OHP) plate 18 disposed over a portion of the chassis 14. One side of the panel 10 will be referred to herein as a heat source side 10A and the opposing side will be referred to herein as a heat sink side 10B. The chassis 14 includes a first side 14A (which defines at least a portion of the heat source side 10A of the panel 10), an opposing second side 14B (which, in various instances, defines at least a portion of the heat sink side 10B of the panel 10), and one or more aperture 22 extending therethrough. The OHP plate(s) 18 is/are disposed over at least a portion of the first side 14A and/or a portion of the second side 14B of the chassis 14. The OHP plate(s) 18 comprise(s) a first face 18A, an opposing second face 18B (which define(s) at least a portion of the heat sink side 10B of the panel 10), and a plurality of internal OHP channels 26. The OHP plate(s) 18 is/are disposed on, or integrally formed with, the chassis 14 such that a portion of OHP plate(s) 18 is/are accessible for thermal interfacing with one or more heat source via the aperture(s) 22 in the chassis, and a portion of the OHP plates(s) 18 is/are accessible for thermal interfacing with a heat sink. More particularly, the panel 10 is constructed such that, via the aperture(s) 22, the first face 18A and/or the second face 18B of a portion(s) of the OHP plate 18 is/are accessible from the heat source side 10A of the panel 10 for thermally interfacing with the heat source(s). Additionally, at least a portion of the second face of the OHP plate(s) 18 is/are accessible from the heat sink side 10B of the panel 10 for thermal interfacing with a heat sink. Therefore, in operation, the OHP plate(s) 10 will remove heat from the heat source(s) and spread the removed heat throughout the OHP plate(s) 18 to provide an isothermal heat rejection surface from which the heat is rejected to the heat sink.

An oscillating heat pipe (OHP) device, such as the OHP plate 18, is a passive heat transfer device that transports heat using two-phase fluid flow within capillary-sized tubes or tunnels (i.e., tubes or tunnels sized such that they have a capillary effect on a working fluid disposed therein) which have a meandering path traveling between areas of the device in thermal contact with one or more heat source and one or more heat sink or cooling zone. The volume of the tunnel pattern is partly filled with a working fluid and hermetically sealed from the outside environment. The tunnel's hydraulic diameter must be small enough and the surface tension of the working fluid great enough such that the fluid disperses itself throughout the tunnel interior area in discrete liquid "plugs" and vapor "bubbles" (i.e. capillary action). In operation, the OHP devices transfer heat from the heat source area(s) to the heat sink(s) or cooling zone(s) as follows: the working fluid (also called cooling fluid) partially evaporates and expands in the tunnel areas at or near the heat source area(s); the associated expansion working fluid vapor forces or drives the working fluid vapor axially in tunnels from the heat source area(s) toward the lower temperature, lower pressure heat sink area(s) or cooling zone(s) where incoming fluid vapor rejects its heat, condenses back to a fluid, and contracts; as a result the working fluid initially near the heat sink area(s) or cooling zone(s) is dislodged by the incoming fluid and is directed through the tunnel's path toward heat source area(s); and the cycle repeats as the working fluid and working fluid vapor oscillates between the tunnel areas in thermal contact with the heat source(s) and the area in thermal contact with the heat sink(s) or cooling zone(s).

The panel 10, and hence the chassis 14 and OHP plate(s) 18, can be constructed to have generally any size and shape. That is, the panel 10, and hence the chassis 14 and OHP plate(s) 18, can have generally any shape and constructed to have a size wherein its dimensions measured in inches or centimeters, or its dimensions measured in feet or meters, or larger. The chassis 14 can comprise any chassis type structure that is constructed to have any shape and size and fabricated of any desired material suitable to meet the technical, structural, thermal, mass, weight and/or other specifications of the respective application. For example, in various instances, the chassis 14 can comprise a lightweight honeycomb construction to which the OHP plate(s) 18 is/are mounted, attached, bonded, fastened or integrally formed therewith. Or, in other embodiments, the chassis 14 can comprise a plurality of ribs, beams or spines that are mounted, attached, bonded, fastened or integrally formed with the OHP plate(s) 18. In various embodiments, the chassis 14 can be a load-bearing structural support member of a purposed structure, or a non-load-bearing member of a purposed structure. Furthermore, it is envisioned that in various embodiments, the OHP plate(s) 18 can be structured and operable to provide or add structural integrity and strength to the chassis 14 and to the panel 10. Hence, the OHP plate 18 can be structured and operable to reduce the weight and mass of the panel 10 while maintaining or improving the structural integrity and strength of the panel 10.

As described above, in operation, the OHP plate(s) 10 will remove heat from the heat source(s) and spread the removed heat throughout the OHP plate(s) 18 to provide an isothermal heat rejection surface from which the heat is rejected to the heat sink. Importantly, the panels 10 are constructed such that the OHP plate(s) 18 have a thermal output flux to heat sink that is equal to or less than a thermal input flux from the heat source(s). The more the thermal output flux is reduced relative to the thermal input flux, the more efficient the panel (i.e., the more efficient the OHP plate(s) 18) will be in removing heat from the heat source(s)). Moreover, as described above, the OHP plate(s) 18 operate(s) as an isothermal device such that the temperature differential or gradient of the OHP plate(s) 18 between the heat source(s) and the heat sink is minimal. For example, it is envisioned that temperature differential or gradient of the OHP plate(s) 18 between the heat source(s) and the heat sink can be between 2° C. to 4° C. or higher depending on the boundary conditions and input power. In various embodiments, so that the thermal output flux is less than the thermal input flux, the OHP plate(s) 18 is/are constructed such that the surface area of the second face 18B of the OHP plate(s) 18 that is/are accessible for thermal interfacing with a heat sink is equal to or greater than the cumulative surface area of the first face 18A and/or the second face 18B of the OHP plate(s) 18 that is/are accessible for thermal interfacing with the heat source(s).

Referring now to FIG. 4, as described above, the panel 10 can be a stand-alone structure or be a panel, wall, housing, partition, outer body or any other structure, part or component of any purposed structure. However, for simplicity and clarity, the panel 10 will be exemplarily described below as an outer wall 30, or a portion of the outer wall 30, of a purposed structure 34, such as a spacecraft. In such embodiments, the panel heat source side 10A and the chassis first side 14A will face and be exposed to an inside or interior space of the purposed structure 34, and the panel heat sink side 10B and at least a portion of the OHP plate second face 18B will face and be exposed to exterior or ambient environment of the purposed structure 34. Moreover, in such embodiments, the exterior/ambient environment will serve as and be the heat sink to which the OHP plate 18 rejects the heat absorbed from the heat source.

Referring now to FIGS. 1, 2, 3, 4 5A, 5B and 5C, in accordance with various embodiments, the heat rejection panel 10 can comprise an OHP plate 18 that is formed or fabricated to have at least one heat source platform 38 that protrude(s) into or extend(s) through the aperture(s) 22 of the chassis 14, and at least one heat rejection wing 42 extending from the heat source platform(s) 38 and is disposed over the second side 14B of the chassis 14. Although the chassis can comprise a plurality of apertures 22, and each OHP plate 18 can comprise a plurality of heat source platforms 38 that each extend into or protrude through a respective aperture 22, for simplicity and clarity the panel 10 will be exemplarily shown and described with regard to FIGS. 5A, 5B, and 5C as comprising a single aperture 22 in the chassis 14 and a single heat source platform 38 formed or fabricated in OHP plate 18. As exemplarily shown in FIGS. 5A, 5B and 5C, the OHP plate 18 comprises a plurality of bends in the X and/or Y and/or Z directions that form the heat source platform 38.

The heat source platform 38 comprises a base 38A to which the heat source can be mounted or otherwise thermally connected, and at least one leg 38B extending away from the base 38A at an angle (e.g., an angle of 30° to 90°) and connecting to the wing(s) 42, which extend(s) away from the legs at an angle (e.g., an angle of 30° to 90°). Accordingly, the heat source platform base 38A and the wing(s) 42 lie separate geometric planes, for example, separate but parallel planes. Importantly, the internal OHP channels 26 are formed within substantially the entire OHP plate 18 such that the OPH channels 26 comprise the same bends in the X, Y and Z directions formed between the heat source platform(s) 38 and the wing(s) 42. For example, in the embodiments where the OPH plate 18 comprises two wings 42 extending from the heat source platform legs 38B, the OHP channels 26 extend from a distal end edge 42E1 of a first one of the wings 42 through and along a length of the respective wing 42 to a first one of the legs 38B, then turn or bend to extend through the length of the leg 38B to the heat source platform base 38A, then turn or bend to pass through the platform base 38A to the opposing leg 38B, then turn or bend to extend through the length of the leg 38B to the opposing wing 42, then turn or bend to extend through the and along the length of the opposing wing to a distal end edge 42E2 of the opposing wing. Hence, the OHP channels meander back and forth in the X and/or Y and/or Z directions through the wings 42 and the heat source platform 38 between the distal end edges 42E1 and 42E2.

Furthermore, as described above, the heat source(s) can be mounted or otherwise thermally connected the heat source platform 38. Particularly, in the various embodiments exemplarily illustrated by FIGS. 5A, 5B and 5C, the heat source platform(s) 38 protrude(s) into or extends through the aperture(s) 22 such that the first face 18A of the portion of the OHP plate 18 that forms the heat source platform 38 is accessible for thermal interfacing with the heat source(s). That is, the heat source(s) can be mounted or otherwise thermally connected to the first face 18A of the portion of the OHP plate 18 that forms the heat source platform 38. Still further, in the various embodiments exemplarily illustrated by FIGS. 5A, 5B and 5C, the heat rejection wing(s) 42 extend from the heat source platform 38 and are disposed over the chassis second side 14B such that the second face 18B of the portion of the OHP plate 18 that forms the wing(s) 42 is accessible for thermal interfacing with the ambient environment (or other suitable heat sink). That is, the OHP plate second face 18B of the wing(s) 42 is in thermal contact with ambient environment such that heat can be rejected from OHP plate second face 18B of the wing(s) 42 and absorbed by the ambient environment. Therefore, in the various embodiments exemplarily illustrated in FIGS. 5A, 5B and 5C, heat is removed or absorbed from the heat source(s) disposed on the interior of the purposed structure 34 and on the panel heat source side 10A by the OH P first face 18A of the portion of the OHP plate 18 that forms the heat source platform 38 and spread throughout the OHP plate 18 via the OHP channels 26 and rejected into the ambient environment by the wings 42 disposed on the exterior of the purposed structure 34 and on the panel heat sink side 10B. Particularly, the heat is absorbed from the heat source(s) disposed on the interior of the purposed structure 34 by the thermal interfacing of the heat source(s) with the first side 18A of OHP plate heat source platform 38, then transferred through the chassis 14 via the aperture 22 and the heat source platform legs 38B, then spread throughout the surface area of the second side 18B of OHP plate wing(s) 42, where that heat is rejected to, or absorbed by, the ambient environment on the exterior of the purposed structure 34, thereby efficiently removing heat from heat source(s).

Referring now to FIGS. 1, 2, 3, 4, 6A, 6B and 6C, in accordance with various embodiments, the heat rejection panel 10 can comprise a plurality of OHP plates 18 that are formed or fabricated to have at least one heat source platform 38 that protrude(s) into or extend(s) through the aperture(s) 22 of the chassis 14, and at least one heat rejection wing 42 extending from the heat source platform(s) 38 and is disposed over the second side 14B of the chassis 14. Although the chassis can comprise a plurality of apertures 22, and each OHP plate 18 can comprise a plurality of heat source platforms 38 that each extend into or protrudes through a respective aperture 22, for simplicity and clarity the panel 10 will be exemplarily shown and described with regard to FIGS. 6A, 6B, and 6C as comprising a single aperture 22 in the chassis 14 and a single heat source platform 38 formed or fabricated in each OHP plate 18. Additionally, although the panel 10 can comprise a plurality of OHP plates 18, for simplicity and clarity the panel 10 will be exemplarily shown and described with regard to FIGS. 6A, 6B, and 6C as comprising a first OHP plate identified by 18-1 and a second OHP plate identified as 18-2. As exemplarily shown in FIGS. 6A, 6B and 6C, each of the first and second OHP plates 18-1 and 18-2 comprise a plurality of bends in the X and/or Y and/or Z directions that form the respective heat source platform 38-1 and 38-2.

Each of the heat source platforms 38-1 and 38-2 comprise a base 38A-1 and 38A-2, respectively, to which a heat source can be mounted or otherwise thermally connected, and at least one leg 38B-1 and 38B-2, respectively, extending away from the bases 38A-1 and 38A-2 at an angle (e.g., an angle of 30° to 90°) and connecting to the wing(s) 42-1 and 42-2, respectively, which extend away from the legs 38B-1 and 38B-2 at an angle (e.g., an angle of 30° to 90°). Accordingly, the heat source platform bases 38-1A and 38-2A and the respective wing(s) 42-1 and 42-2 lie in separate geometric planes, for example, separate but parallel planes. Importantly, the respective internal OHP channels 26-1 and 26-2 are formed within substantially the entire respective OHP plate 18-1 and 18-2 such that the OPH channels 26-1 and 26-2 comprise the same bends in the X, Y and Z directions formed between the respective heat source platforms 38-1 and 38-2 and wings 42-1 and 42-2.

For example, in the embodiments where each of the OHP plates 18-1 and 18-2 comprise two wings 42-1 and 42-2, respectively, extending from the respective heat source platform legs 38B-1 and 38B-2, the respective OHP channels 26-1 and 26-2 extend from a respective distal end edge 42E1-1 and 42E1-2 of a respective first one of the wings 42-1 and 42-2 through and along a length of the respective wings 42-1 and 42-2 to a first one of the respective legs 38B-1 38B-2, then turn or bend to extend through the length of the legs 38B-1 and 38B-2 to the respective heat source platform bases 38A-1 and 38A-2, then turn or bend to pass through the platform bases 38A-1 and 38A-2 to the respective opposing leg 38B-1 and 38B-2, then turn or bend to extend through the length of the respective leg 38B-1 and 38B-2 to the respective opposing wings 42-1 and 42-2, then turn or bend to extend through the and along the length of the respective opposing wings 42-1 and 42-2 to the respective distal end edge 42E2-1 and 42E2-2 of the respective opposing wings 42-1 and 42-2. Hence, the OHP channels 26-1 and 26-2 meander back and forth in the X and/or Y and/or Z directions through the respective wings 42-1 and 42-2 and heat source platforms 38-1 and 38-2 between the respective distal end edges 42E1-1 and 42E2-1, and 42E1-2 and 42E2-2.

Figure 6C:
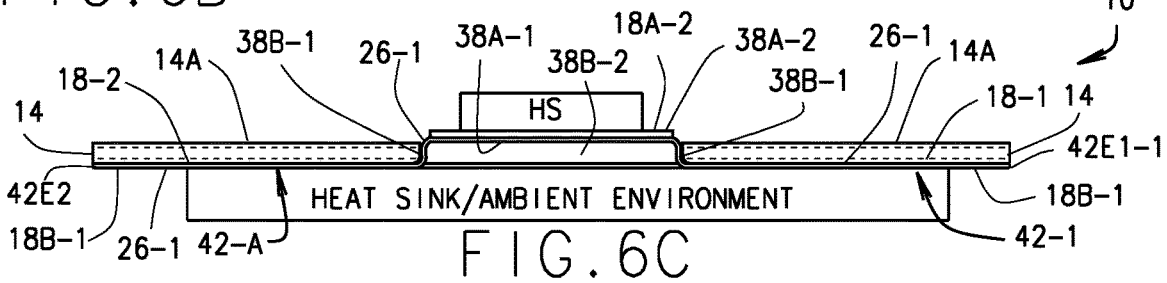

As exemplarily illustrated in FIGS. 6A, 6B and 6C, when the panel 10 is assembled, the heat source platform 38-2 of the second OHP plate 18-2 will overlap and be disposed on top of and in thermal contact with the heat source platform 38-1 of the first OHP plate 18-1, or vice-versa. In such embodiments, the respective OHP platforms 38-1 and 38-2 combine to form a multi-layered or stacked heat source platform 38L that is accessible to thermal interfacing with the heat source(s). Additionally, in such embodiments, the respective internal OHP channels 26-1 and 26-2 will overlap each other, or be stacked on top of each other, providing multi-layered or stacked OHP channels within the multi-layer heat source platform 38L. In various instances, each respective layer of OHP channels can run in a different direction than the OHP channels of the other layer(s). For example, in the exemplary embodiment shown in FIGS. 6A, 6B and 6C, the OHP channels 26-1 of the first OHP plate 18-1 will run substantially orthogonally with the OHP channels 26-2 of the second OHP plate 18-2. Furthermore, in such embodiments, the wing(s) 42-1 of the first OHP plate 18-1 extend from the heat source platform 38-1 in a different direction than the wing(s) 42-2 of the second OHP plate 18-2 extend from the heat source platform 38-2 and is/are disposed over different section(s) of the second side 14B of the chassis 14. Therefore, the combined or cumulative surface area of the OHP plate second faces 18B-1 and 18B-2 of the wings 42-1 and 42-2 (i.e., the surface area of the heat rejection surface) is substantially larger than the surface area of heat absorption surface (i.e., the surface area of the OHP plate first face 18A of the multi-layered heat source platform 38L).

In such embodiments, the heat source(s) can be mounted to, or otherwise thermally connected to, the multi-layered heat source platform 38L (e.g., the first OHP plate heat source platform 38-1 layered with (i.e., on top of or under) the second OHP plate heat source platform 38-2). Particularly, in the various embodiments exemplarily illustrated by FIGS. 6A, 6B and 6C, the layered heat source platform 38L protrudes into or extends through the aperture 22 such that the first face 18A of the portion of the OHP plate 18 that forms the uppermost or top heat source platform 38 is accessible for thermal interfacing with the heat source(s). That is, the heat source(s) can be mounted or otherwise thermally connected to the first face 18A of the portion of the OHP plate 18 that forms the uppermost of top heat source platform 38. Still further, in the various embodiments exemplarily illustrated by FIGS. 6A, 6B and 6C, the heat rejection wing(s) 42 extend from the heat source platform 38 as described above and are disposed over the chassis second side 14B such that the second face 18B of the portion of the OHP plates 18 that forms the wings 42 (e.g., the first and second OHP plate wings 42-1 and 42-2) is accessible for thermal interfacing with the ambient environment (or other suitable heat sink). That is, the OHP plates (e.g., first and second OHP plates 18-1 and 18-2) second faces 18B (e.g., second faces 18B-1 and 18B-2) of the wing(s) 42 (e.g., wings 42-1 and 42-2) are in thermal contact with ambient environment such that heat can be rejected from OHP plates second faces 18B (e.g., second faces 18-1B and 18-2B) of the wing(s) 42 (e.g., wings 42-1 and 42-2) and absorbed by the ambient environment.

Therefore, in the various embodiments exemplarily illustrated in FIGS. 6A, 6B and 6C, heat is removed or absorbed from the heat source(s) disposed on the interior of the purposed structure 34 and on the panel heat source side 10A by the OHP first face 18A of the portion of the OHP plate 18 that forms the uppermost or top layer of the layered heat source platform 38L and, via the thermal contact between each heat source platform 38A of the layered heat source platform, spread throughout the wings 42 (e.g., wings 42-1 and 42-2) of the plurality of OHP plates 18 (e.g., OHP plates 18-1 and 18-2) via the respective OHP channels 26 and rejected into the ambient environment by the wings 42 disposed on the exterior of the purposed structure 34 and on the panel heat sink side 10B. Particularly, the heat is absorbed from the heat source(s) disposed on the interior of the purposed structure 34 by the thermal interfacing of the heat source(s) with the first side 18A of OHP plate 18 that provides the uppermost heat source platform 38 of the multi-layered heat source platform 38L, then transferred through the chassis 14 via the aperture 22 and the heat source platforms legs 38B, then spread throughout the surface area of the second side 18B of OHP plate wing(s) 42 of each OHP plate 18, where that heat is rejected to, or absorbed by, the ambient environment on the exterior of the purposed structure 34, thereby efficiently removing heat from heat source(s).

In various embodiments, wherein the heat source platform 38 comprises a multi-layer heat source platform 38L, the internal OHP channels 26 of the heat source platform 38 of each OHP plate 18 that forms the multi-layer heat source platform 38L (e.g., the internal OHP channels 26 of each layer of the multi-layer heat source platform 38L) can be discrete or separated from the internal OHP channels 26 of the heat source platform 38 of the other OHP plates 18 (e.g., the internal OHP channels 26 of the other layers of the multi-layer heat source platform 38L). In such embodiments, the internal OHP channels 26 of the heat source platform 38 of each OHP plate 18 are merely in thermal contact with the internal OHP channels 26 of the other OHP plates 18. In such embodiments, the working fluid within the OHP channels 26 of one or more OHP plate 18 of multi-layer heat source platform 38L (e.g., the OHP channels of one or more layer of the multi-source platform 38L) can be different than the working fluid within the OHP channels 26 of one or more other OHP plate 18 of multi-layer heat source platform 38L (e.g., the OHP channels of one or more other layer of the multi-source platform 38L). For example, the working fluid within the internal OHP channels 26 of one OHP plate 18 (e.g., one layer) can be ammonia while the working fluid within the internal OHP channels 26 of another OHP plate 18 (e.g., a different layer) can be acetone.

Alternatively, in various other embodiments, the internal OHP channels 26 of the heat source platform 38 of any one or more of the OHP plates 18 that form the multi-layer heat source platform 38L (e.g., the internal OHP channels 26 of any one or more layer of the multi-layer heat source platform 38L) can be fluidly connected to or with the internal OHP channels 26 of any one or more of the other OHP plates 18 that form the multi-layer heat source platform 38L (e.g., the internal OHP channels 26 of any one or more other layer of the multi-layer heat source platform 38L). In such embodiments the fluidly connected OHP plates 18 (e.g., fluidly connected layers of the multi-layer heat source platform 39L) can comprise ports or stents that fluidly connect the internal OHP channels 26 of one OHP plate 18 with the internal channels 26 of one or more other OHP plate 18.

Referring now to FIGS. 1, 2, 3, 4, 7A, 7B and 7C, as described above, in various embodiments, the heat rejection panel 10 can comprise a plurality of OHP plates 18. For example, in various instances the panel 10 can comprise a plurality of OHP plates 18 that are formed or fabricated to have a heat source platform 38 that protrudes into or extends through the aperture 22 of the chassis 14 and provides a portion (e.g., ½, ⅔, ¼, etc.) of a cumulative heat source platform 38C. In such instances, each OHP plate 18 further includes a heat rejection wing 42 extending from the respective heat source platforms 38 and is disposed over the second side 14B of the chassis 14. For simplicity and clarity, FIGS. 7A, 7B and 7C will exemplarily illustrate a panel 10 comprising four OHP plates identified as 18-3, 18-4, 18-5 and 18-6. As exemplarily shown in FIGS. 7A, 7B and 7C, each of the four OHP plates 18-3, 18-4, 18-5 and 18-6 comprise a plurality of bends in the X and/or Y and/or Z directions that form the respective heat source platform 38-3, 38-4, 38-5, and 38-6.

Each of the heat source platforms 38-3, 38-4, 38-5 and 38-6 comprise a base 38-A3, 38A-4, 38A-5 and 38A-6, respectively, to which a heat source can be mounted or otherwise thermally connected, and at least one leg 38B-3, 38B-4, 38B-5 and 38B-6, respectively, extending away from the bases at an angle (e.g., an angle of 30° to 90°) and connecting to the wing(s) 42-3, 42-4, 42-5 and 42-6, respectively, which extend away from the legs 38-1B and 38-2B at an angle (e.g., an angle of 30° to 90°). Accordingly, the heat source platform bases 38-A3, 38A-4, 38A-5 and 38A-6 and the respective wings 42-3, 42-4, 42-5 and 42-6 lie in separate geometric planes, for example, separate but parallel planes. Importantly, the respective internal OHP channels 26-3, 26-4, 26-5 and 26-6 are formed within substantially the entire respective OHP plate such that the OPH channels 26-3, 26-4, 26-5 and 26-6 comprise the same bends in the X, Y and Z directions formed between the respective heat source platforms 38-3, 38-4, 38-5 and 38-6 and wings 42-3, 42-4, 42-5 and 42-6.

For example, in the embodiments exemplarily shown in FIGS. 7A, 7B and 7C, the respective OHP channels 26-3, 26-4, 26-5 and 26-6 extend from a respective distal end edge 42E-3, 42E-4, 42E-5 and 42E-6 of the respective wings 42-3, 42-4, 42-5 and 42-6 through and along a length of the respective wing to a respective leg 38B-3, 38B-4, 38B-5 and 38B-6, then turn or bend to extend through the length of the respective legs to the respective heat source platform bases 38A-3, 38A-4, 38A-5 and 38A-6, then turn or bend to pass through the respective platform base 38A-3, 38A-4, 38A-5 and 38A-6. Hence, the OHP channels 26-3, 26-4, 26-5 and 26-6 meander back and forth in the X and/or Y and/or Z directions through the respective wings 42-3, 42-4, 42-5 and 42-6 and heat source platforms 38-3, 38-4, 38-5 and 38-6.

As exemplarily illustrated in FIGS. 7A, 7B and 7C, when the panel 10 is assembled, each of the heat source platforms 38-3, 38-4, 38-5 and 38-6 protrudes into or extends through the aperture 22 such that each of the heat source platforms 38-3, 38-4, 38-5 and 38-6 provide or form a portion (e.g., ¼) of the cumulative heat source platform 38C. Moreover, each of the heat source platforms 38-3, 38-4, 38-5 and 38-6 protrudes into or extends through the aperture 22 such that the first faces 18A-3, 18A-4, 18A-5 and 18A-6 of the portion of the respective OHP plate 18-3, 18-4, 18-5 and 18-6 that forms the respective heat source platform 38-3, 38-4, 38-5 and 38-6 is accessible for thermal interfacing with the heat source(s). Accordingly, one or more heat source can be mounted to, or otherwise thermally connected to, one or more of the heat source platforms 38-3, 38-4, 38-5 and 38-6. Furthermore, the heat rejection wings 42-3, 42-4, 42-5 and 42-6 extend from the heat source platform 38 as described above and are disposed over the chassis second side 14B such that the second faces 18B-3, 18B-4, 18B-5 and 18B-6 of the portion of each of the OHP plates 18-3, 18-4, 18-5 and 18-6 that form the respective wings 42-3, 42-4, 42-5 and 42-6 is accessible for thermal interfacing with the ambient environment (or other suitable heat sink). That is, the OHP plates 18-3, 18-4, 18-5 and 18-6 second faces 18B-3, 18B-4, 18B-5 and 18B-6 of the wings 42-3, 42-4, 42-5 and 42-6 are in thermal contact with ambient environment such that heat can be rejected from OHP plates second faces 18B-3, 18B-4, 18B-5 and 18B-6 of the wings 42-3, 42-4, 42-5 and 42-6 and absorbed by the ambient environment.

Therefore, in the various embodiments exemplarily illustrated in FIGS. 7A, 7B and 7C, heat is removed or absorbed from the heat sources disposed on the interior of the purposed structure 34 and on the panel heat source side 10A by the OHP first faces 18A-3, 18A-4, 18A-5 and 18A-6 of the portion of the OHP plates 18-3, 18-4, 18-5 and 18-6 that form the heat source platforms 38-3, 38-4, 38-5 and 38-6. The heat is then spread throughout the OHP plates 18-3, 18-4, 18-5 and 18-6 via the respective OHP channels 26-3, 26-4, 26-5 and 26-6 and rejected into the ambient environment by the wings 42-3, 42-4, 42-5 and 42-6 disposed on the exterior of the purposed structure 34 and on the panel heat sink side 10B. Particularly, the heat is absorbed from the heat source(s) disposed on the interior of the purposed structure 34 by the thermal interfacing of the heat source(s) with the first sides 18A-3, 18A-4, 18A-5 and 18A-6 of OHP plates 18-3, 18-4, 18-5 and 18-6. The heat is then transferred through the chassis 14 via the aperture 22 and the heat source platforms legs 38B-3, 38B-4, 38B-5 and 38B-6, then spread throughout the surface area of the second sides 18B-3, 18B-4, 18B-5 and 18B-6 of OHP plate wings 42-3, 42-4, 42-5 and 42-6, where that heat is rejected to, or absorbed by, the ambient environment on the exterior of the purposed structure 34, thereby efficiently removing heat from heat source(s).

It is envisioned that various embodiments such as those exemplarily illustrated in FIGS. 7A, 7B and 7C, each of the OHP plates 18-3, 18-4, 18-5 and 18-6 can be independent and discrete from each other. In such instances the working fluid within the internal OHP channels 26 of the OHP plates 18-3, 18-4, 18-5 and 18-6 can be the same. Or, alternatively, one or more of the OHP plates 18-3, 18-4, 18-5 and/or 18-6 can be different than the working fluid within one or more of the other OHP plates 18-3, 18-4, 18-5 and 18-6. For example, the working fluid of one or more of the OHP plates 18-3, 18-4, 18-5 and 18-6 can be ammonia while the working fluid of one more of the other OHP plates 18-3, 18-4, 18-5 and 18-6 can be acetone.

Alternatively, in various other embodiments, the internal OHP channels 26 of one or more of the OHP plates 18-3, 18-4, 18-5 and 18-6 can be fluidly connected to or with the internal OHP channels 26 of any one or more of the other OHP plates 18-3, 18-4, 18-5 and 18-6. In such embodiments the fluidly connected heat source platforms 38 can comprise ports or stents that fluidly connect the internal OHP channels 26 of one or more of the heat source platform 38-3, 38-4, 38-5 and 38-6 with the internal channels 26 of one or more of the other heat source platform 38-3, 38-4, 38-5 and 38-6.

Referring now to FIGS. 1, 2, 3, 4, 8A, 8B and 8C, as described above, in various embodiments, the heat rejection panel 10 can comprise a plurality of OHP plates 18 that are formed or fabricated to have at least one heat source platform 38 that protrude(s) into or extend(s) through the aperture(s) 22 of the chassis 14, and at least one heat rejection wing 42 extending from the heat source platform(s) 38 and is disposed over the second side 14B of the chassis 14. Although the chassis 14 can comprise a plurality of apertures 22, and each OHP plate 18 can comprise a plurality of heat source platforms 38 that each extend into or protrudes through a respective aperture 22, for simplicity and clarity the panel 10 will be exemplarily shown and described with regard to FIGS. 8A, 8B, and 8C as comprising a single aperture 22 in the chassis 14 and a single heat source platform 38 formed or fabricated in each OHP plate 18. Additionally, although the panel 10 can comprise a plurality of OHP plates 18, for simplicity and clarity the panel 10 will be exemplarily shown and described with regard to FIGS. 8A, 8B, and 8C as comprising three OHP plates 18-7, 18-8 and 18-9, each of which comprise a plurality of bends in the X and/or Y and/or Z directions that form the respective heat source platform 38-7, 38-8 and 38-9.

Each of the heat source platforms 38-7, 38-8 and 38-9 comprise a respective base 38A-7, 38A-8 and 38A-9 to which a heat source can be mounted or otherwise thermally connected, and at least one leg 38B-7, 38B-8 and 38B-9, respectively, extending away from the bases 38A-7, 38A-8 and 38A-9 at an angle (e.g., an angle of 30° to 90°) and connecting to the wing(s) 42-7, 42-8 and 42-9, respectively, which extend away from the legs 38B-7, 38B-8 and 38B-9 at an angle (e.g., an angle of 30° to 90°). Accordingly, the heat source platform bases 38A-7, 38A-8 and 38A-9 and the respective wing(s) 42-7, 42-8 and 42-9 lie in separate geometric planes, for example, separate but parallel planes, or separate non-parallel planes that intersect each other at an angle between 0° and 90°. Importantly, the respective internal OHP channels 26-7, 26-8 and 26-9 are formed within substantially the entire respective OHP plate 18-7, 18-8 and 18-9 such that the OPH channels 26-7, 26-8 and 26-9 comprise the same bends in the X, Y and Z directions formed between the respective heat source platforms 38-7, 38-8 and 38-9 and wings 42-7, 42-8 and 42-9.

For example, as described above, in the embodiments where one or more of the OHP plates 18-7, 18-8 and/or 18-2 comprise(s) two wings 42 extending from the respective heat source platform legs 38B, the respective OHP channels 26-7, 26-8 and/or 26-9 extend from a respective distal end edge 42E1-7, 42E1-8 and/or 42E1-9 of a respective first one of the wings 42-7, 42-8 and/or 42-9 through and along a length of the respective wing(s) to a first one of the respective leg(s) 38B-7, 38B-8 and/or 38B-9, then turn or bend to extend through the length of the leg(s) to the respective heat source platform base(s) 38A-7, 38A-8 and/or 38A-9, then turn or bend to pass through the platform base(s) to the respective opposing leg(s) 38B-7, 38B-8 and/or 38B-9, then turn or bend to extend through the length of the respective leg(s) to the respective opposing wing(s) 42-7, 42-8 and/or 42-9, then turn or bend to extend through the and along the length of the respective opposing wing(s)s to the respective distal end edge 42E2-7, 42E2-8 and/or 42E2-9 of the respective opposing wing(s). Or, in the embodiments where one or more of the OHP plates 18-7, 18-8 and/or 18-2 comprise(s) one wing 42 extending from the respective heat source platform leg 38B, the respective OHP channels 26-7, 26-8 and/or 26-9 extend from a respective distal end edge of the respective wing 42-7, 42-8 and/or 42-9 through and along a length of the respective wing to the respective leg 38B-7, 38B-8 and/or 38B-9, then turn or bend to extend through the length of the leg to the respective heat source platform base 38A-7, 38A-8 and/or 38A-9, then turn or bend to pass through the heat source platform base. Hence, the OHP channels 26-7, 26-8 and 26-9 meander back and forth in the X and/or Y and/or Z directions through the respective wing(s) and heat source platforms.

As exemplarily illustrated in FIGS. 8A, 8B and 8C, in various embodiments, the panel 10 can comprise one OHP plate 18-7 that comprises a pair of wings 42-7 extending from the heat source platform 38-7 and are disposed over the second side of the chassis 14B. The panel 10 exemplarily illustrated in FIGS. 8A, 8B and 8C additionally comprises two OHP plates 18-8 and 18-9 that comprise a single 42-8 and 42-9, respectively, extending from the respective heat source platforms 38-8 and 38-9 and are disposed over the second side of the chassis 14B. More particularly, the OHP plate 18-7 comprises a heat source platform 38-7 that forms a bridge between the opposing wings 42-7 (as do the heat source platforms shown FIGS. 5A, 5B, 5C, 6A, 6B 6C), while the OHP plates 18-8 and 18-9 comprise heat source platforms 38-8 and 38-9 that extend from the respective wings 42-8 and 42-9 in 'U-shaped or hook-shaped' configuration such that they fold back and extend over the first faces 18A-8 and 18A-9 respectively. Accordingly, when the panel 10 is assembled, the heat source platform 38-7 will protrude into or extend through the chassis aperture 22 such that the heat source platform 38-7 is generally centered within the chassis aperture 22 (as do the heat source platforms shown in FIGS. 5A, 5B, 5C, 6A, 6B 6C). Further, when the panel 10 is assembled, the heat source platforms 38-8 and 38-9 will extend through the chassis aperture 22 along the sides of the heat source platform 38-7 and fold back and be disposed over the first side 14A of the chassis 14 such that the heat source platforms 38-7, 38-8 and 38-9 are disposed adjacent, or next to, each other and provide three separate heat source platforms to which one or more of heat source can be mounted or otherwise thermally connected. In such instances the working fluid within the internal OHP channels 26 of the OHP plates 18-7, 18-8 and 18-9 can be the same. Or, alternatively, one or more of the OHP plates 18-7, 18-8 and/or 18-9 can be different than the working fluid within one or more of the other OHP plates 18-7, 18-8 and/or 18-9. For example, the working fluid of one or more of the OHP plates 18-7, 18-8 and/or 18-9 can be ammonia while the working fluid of one more of the other OHP plates 18-7, 18-8 and/or 18-9 can be acetone, while the working fluid of one more of the still other OHP plates 18-7, 18-8 and/or 18-9 can be yet a different fluid.

Furthermore, in the various embodiments exemplarily illustrated by FIGS. 8A, 8B and 8C, the heat source platform 38-7 protrudes into or extends through the aperture 22 such that the first face 18A-7 of the portion of the OHP plate 18-7 the forms the heat source platform 38-7 is accessible for thermal interfacing with the heat source(s). That is, the heat source(s) can be mounted or otherwise thermally connected to the first face 18A-7 of the portion of the OHP plate 18-7 the forms the heat source platform 38-7. Additionally, the heat rejection wings 42-7 extend from the heat source platform 38-7 and are disposed over the chassis second side 14B such that the second face 18B-7 of the portion of the OHP plate 18-7 that forms the wings 42-7 is accessible for thermal interfacing with the ambient environment (or other suitable heat sink). That is, the OHP plate second face 18B-7 of the wings 42-7 is in thermal contact with ambient environment such that heat can be rejected from OHP plate second face 18B-7 of the wings 42-7 and absorbed by the ambient environment.

Further yet, in the various embodiments exemplarily illustrated by FIGS. 8A, 8B and 8C, the heat source platforms 38-8 and 38-9 extend through the aperture 22 such that the second faces 18B-8 and 18B-9 of the portion of the respective OHP plates 18-8 and 18-9 that form the respective heat source platforms 38-8 and 38-9 are accessible for thermal interfacing with the heat source(s). That is, the heat source(s) can be mounted or otherwise thermally connected to the second faces 18B-8 and 18B-9 of the portions of the OHP plates 18-8 and 18-9 that form the respective heat source platforms 38-8 and 38-9. Additionally, the heat rejection wings 42-8 and 42-9 extend from the respective heat source platform 38-8 and 38-9 and are disposed over the chassis second side 14B such that the second faces 18B-8 and 18B-9 of the portion of the OHP plates 18-8 and 18-9 that form the wings 42-8 and 42-9 are accessible for thermal interfacing with the ambient environment (or other suitable heat sink). That is, the OHP plate second faces 18B-8 and 18B-9 of the wings 42-8 and 42-9 are in thermal contact with ambient environment such that heat can be rejected from OHP plate second faces 18B-8 and 18B-9 of the wings 42-8 and 42-9 and absorbed by the ambient environment Therefore, in the various embodiments exemplarily illustrated in FIGS. 8A, 8B and 8C, heat is removed or absorbed from the heat source(s) disposed on the interior of the purposed structure 34 and on the panel heat source side 10A by the OHP first face 18A-7 and the OHP second faces 18B-8 and 18B-9 of the portion of the respective OHP plates 18-7, 18-8 and 18-9 that forms the respective heat source platforms 38-7, 18-9 and 18-9 and spread throughout the respective OHP plates 18-7, 18-8 and 18-9 via the respective OHP channels 26-7, 26-8 and 26-9 then rejected into the ambient environment by the respective wings 42-7, 42-8 and 42-9 disposed on the exterior of the purposed structure 34 and on the panel heat sink side 10B. Particularly, the heat is absorbed from the heat source(s) disposed on the interior of the purposed structure 34 by the thermal interfacing of the heat source(s) with the first side 18A-7 of OHP plate heat source platform 38-7, and by thermal interfacing of the heat source(s) with the second sides 18B-8 and 18B-9 of OHP plate heat transfer platforms 38-8 and 38-9, then transferred through the chassis 14 via the aperture 22 and the heat source platform legs 38B-7, 38B-8 and 38B-9, then spread throughout the surface area of the second sides 18B-7, 18B-8 and 18B-9 of OHP plate wings 42-7, 42-8 and 42-9, where that heat is rejected to, or absorbed by, the ambient environment on the exterior of the purposed structure 34, thereby efficiently removing heat from heat source(s).

Referring now to FIGS. 9A, 9B and 9C, in various embodiments, the heat rejection panel 10 can comprise a plurality of OHP plates 18 that are formed or fabricated to have at least one heat source platform 38 that extends through a corresponding one of a plurality of apertures 22 in the chassis 14, and at least one heat rejection wing 42 extending from the heat source platform(s) 38 and is disposed over the second side 14B of the chassis 14. Although each OHP plate 18 can comprise a plurality of heat source platforms 38, for simplicity and clarity the panel 10 will be exemplarily shown and described with regard to FIGS. 9A, 9B, and 9C as comprising a single heat source platform. Additionally, although the panel 10 can comprise a plurality of OHP plates 18, for simplicity and clarity the panel 10 will be exemplarily shown and described with regard to FIGS. 9A, 9B, and 9C as comprising a plurality of port side OHP plates 18-10 and a plurality of starboard side OHP plates 18-11 each of which comprise a plurality of bends in the X and/or Y and/or Z directions that form the respective heat source platforms 38-10 and 38-11.

Each of the heat source platforms 38-10 and 38-11 comprise a base 38A-10 and 38A-11 to which a heat source can be mounted or otherwise thermally connected, and a leg 38B-10 and 38B-11, respectively, extending away from the bases and connecting the heat source platforms 38-10 and 38-11 to the wing(s) 42-10 and 42-11, respectively, such that the heat source platforms 38-10 and 38-11 extend away from the wings 42-10 and 42-11 at an angle of 1° to 179°, e.g., 90°. Accordingly, the heat source platform bases 38A-10 and 38A-11 and the respective wing(s) 42-10 and 42-11 lie in separate non-parallel geometric planes that intersect each other at an angle between 1° and 179°, e.g., 90°. Therefore, when the panel 10 is assembled and the heat source platforms 38-10, and 38-11 extend through the apertures 22 in the chassis, the heat source platforms 38-10 and 38-11 will extend away from the chassis first side 14A at angle of 1° to 179°. Importantly, the respective internal OHP channels 26-10 and 26-11 are formed within substantially the entire respective OHP plate 18-10 and 18-11 such that the OPH channels 26-10 and 26-11 comprise the same bends in the X, Y and Z directions as formed between the respective heat source platforms 38-10 and 38-11 and wings 42-10 and 42-11. For example, in the embodiments exemplarily illustrated in FIGS. 9A, 9B and 9C, the respective OHP channels 26-10, and 26-11 extend from a respective distal end edge of the respective wing 42-10 and 42-11 through and along a length of the respective wing to the respective leg 38B-10 and 38B-11, then turn or bend to extend through the length of the leg to the respective heat source platform base 38A-10 and 38A-11, then turn or bend to pass through the heat source platform base 38A-10 and 38A-11. Hence, the OHP channels 26-10 and 26-11 meander back and forth in the X and/or Y and/or Z directions through the respective wings 42-10 and 42-11 and heat source platforms 38-10 and 38-11.

As described above, in various embodiments, exemplarily illustrated in FIGS. 9A, 9B and 9C, the panel 10 can comprise a plurality of port side OHP plates 18-10 and a plurality of starboard side OHP plates 18-11, wherein the heat source platforms 42-10 and 42-11 extend away from the respective wings 42-10 and 42-11 at an angle. This angle is exemplarily illustrated to by approximately a 90° angle, but it can be any desired angle between 1° and 179°. In various embodiments, each of the heat source platforms 42-10 and 42-11 can extend through a corresponding separate one of a plurality of apertures 22 in the chassis 14. In such embodiments, either side or both sides, of the respective heat source platform bases 38A-10 and/or 38A-11 are available to thermally interface with one or more heat sources. That is, one or more heat source can be mounted or otherwise thermally connected either side or both sides, of the respective heat source platform bases 38A-10 and/or 38A-11.

Alternatively, in various embodiments, as exemplarily shown in FIGS. 9A, 9B and 9C, the OHP plates 18-10 and 18-11 can be configured such that the heat source platform 38-10 from a port side OHP plate 18-10 and the heat source platform 38-11 from a starboard side OHP plate 18-11 can both extend through a corresponding single corresponding one of the chassis aperture 22 such that heat source platform bases 38A-10 and 38A-11 are in a back-to-back disposition and are in thermal contact with each other. In such embodiments, the respective OHP platforms 38-10 and 38-11 combine to form a multi-layered or stacked heat source platform 38S, wherein either side or both sides of the layered heat source platform 38S is accessible to thermally interface with one or more heat source. That is, one or more heat source can be mounted or otherwise thermally connected the heat source platform base 38A-10 and/or the heat source platform base 38A-11.

Additionally, in such embodiments, the respective internal OHP channels 26-10 and 26-11 will overlap each other, or be stacked on top of each other, providing multi-layered or stacked OHP channels within the multi-layer heat source platform 38S. Furthermore, in such embodiments, the wing 42-10 of the OHP plate 18-10 extend from the heat source platform 38-10 in a different direction than the wing 42-11 of the OHP plate 18-11 extend from the heat source platform 38-11 and are disposed over different sections of the second side 14B of the chassis 14. Therefore, the combined or cumulative surface area of the OHP plate second faces 18B-10 and 18B-11 of the wings 42-10 and 42-11 (i.e., the surface area of the heat rejection surface) is substantially larger than the surface area of heat absorption surface (i.e., the surface area of multi-layered heat source platform 38S). It is envisioned that in various instances a thermally insulative barrier can be disposed between the heat source platforms 38-10 and 38-11, such that the heat source platforms 38-10 and 38-11 are thermally isolated from each other.

In various embodiments, the internal OHP channels 26-10 are merely in thermal contact with the internal OHP channels 26-11 such that the working fluid within the OHP channels 26-10 can be different than the working fluid within the OHP channels 26-11. For example, the working fluid within the internal OHP channels 26-10 can be ammonia while the working fluid within the internal OHP channels 26-11 can be acetone. Alternatively, in various other embodiments, the internal OHP channels 26-10 can be fluidly connected to or with the internal OHP channels 26-11. In such embodiments the fluidly connected heat source platforms 38-10 and 38-11 can comprise ports or stents that fluidly connect the internal OHP channels 26 of heat source platform 38-10 with the internal channels 26 of heat source platform 38-11.

In such embodiments wherein the panel 10 comprise the plurality of multi-layer heat source platforms 38S, each multi-layered heat source platform 38S extends through the respective aperture 22 such that the first faces 18A-10 and 18A-11 of the portion of the respective OHP plates 18-10 and 18-11 the forms the respective heat source platforms 38-10 and 38-11 is accessible for thermal interfacing with the heat source(s). That is, the heat source(s) can be mounted or otherwise thermally connected to the first faces 18A-10 and 18A-11 of the portion of the OHP plates 18-10 and 18-11 the forms the respective heat source platforms 38-10 and 38-11. Additionally, the heat rejection wings 42-10 and 42-11 extend from the respective heat source platforms 38-10 and 38-11 and are disposed over the chassis second side 14B such that the second face 18B-10 and 18B-11 of the portion of the OHP plates 18-10 and 18-11 that form the respective wings 42-10 and 42-11 is accessible for thermal interfacing with the ambient environment (or other suitable heat sink). That is, the OHP plate second faces 18B-10 and 18B-11 of the wings 42-10 and 42-11 are in thermal contact with ambient environment such that heat can be rejected from OHP plate second faces 18B-10 and 18B-11 of the wings 42-10 and 42-11 and absorbed by the ambient environment.

Therefore, in such embodiments wherein the panel 10 comprises the plurality of multi-layer heat source platforms 38S, heat is removed or absorbed from the heat source(s) disposed on the interior of the purposed structure 34 and on the panel heat source side 10A by the OHP first faces 18A-10 and 18A-11 of the portion of the respective OHP plates 18-10 and 18-11 that form the respective heat source platforms 38-10 and 18-11 and spread throughout the respective OHP plates 18-10 and 18-11 via the respective OHP channels 26-10 and 26-11 then rejected into the ambient environment by the respective wings 42-10 and 42-11 disposed on the exterior of the purposed structure 34 and on the panel heat sink side 10B. Particularly, the heat is absorbed from the heat source(s) disposed on the interior of the purposed structure 34 by the thermal interfacing of the heat source(s) with the first side 18A-10 and/or the first side 18A-11 of OHP plate heat source platforms 38-10 and 38-11 that define the multilayered heat source platform 38S, then transferred through the chassis 14 via the aperture 22 and the heat source platform legs 38B-10 and/or 38B-11, then spread throughout the surface area of the second sides 18B-10 and/or 18B-11 of OHP plate wings 42-10 and/or 42-11, where that heat is rejected to, or absorbed by, the ambient environment on the exterior of the purposed structure 34, thereby efficiently removing heat from heat source(s).

In such embodiments wherein the panel 10 comprise the plurality of heat source platforms 38-10 and 38-11, each heat source platform 38-10 and 38-11 extends through the respective aperture 22 such that the first faces 18A-10 and 18A-11, and the second faces 18B-10 and 18B-11, of the portion of the respective OHP plates 18-10 and 18-11 the forms the respective heat source platforms 38-10 and 38-11 are accessible for thermal interfacing with the heat source(s). That is, the heat source(s) can be mounted or otherwise thermally connected to the first faces 18A-10 and 18A-11, and/or the second faces 18B-10 and 18B-11, of the portion of the OHP plates 18-10 and 18-11 the forms the respective heat source platforms 38-10 and 38-11. Additionally, the heat rejection wings 42-10 and 42-11 extend from the respective heat source platforms 38-10 and 38-11 and are disposed over the chassis second side 14B such that the second face 18B-10 and 18B-11 of the portion of the OHP plates 18-10 and 18-11 that form the respective wings 42-10 and 42-11 is accessible for thermal interfacing with the ambient environment (or other suitable heat sink). That is, the OHP plate second faces 18B-10 and 18B-11 of the wings 42-10 and 42-11 are in thermal contact with ambient environment such that heat can be rejected from OHP plate second faces 18B-10 and 18B-11 of the wings 42-10 and 42-11 and absorbed by the ambient environment.

Therefore, in such embodiments wherein the panel 10 comprises the plurality of heat source platform 38-10 and 38-11 extend through individual respective apertures 22, heat is removed or absorbed from the heat source(s) disposed on the interior of the purposed structure 34 and on the panel heat source side 10A by the OHP first faces 18A-10 and 18A-11, and/or second faces of the portions of the respective OHP plates 18-10 and 18-11 that form the respective heat source platforms 38-10 and 18-11 and spread throughout the respective OHP plates 18-10 and 18-11 via the respective OHP channels 26-10 and 26-11 then rejected into the ambient environment by the respective wings 42-10 and 42-11 disposed on the exterior of the purposed structure 34 and on the panel heat sink side 10B. Particularly, the heat is absorbed from the heat source(s) disposed on the interior of the purposed structure 34 by the thermal interfacing of the heat source(s) with the first sides 18A-10 and 18A-11, and/or the second sides 18B-10 and 18B-11 of OHP plate heat source platforms 38-10 and 38-11 that define the respective heat source platform 38-10 and 38-11, then transferred through the chassis 14 via the aperture 22 and the heat source platform legs 38B-10 and 38B-11, then spread throughout the surface area of the second sides 18B-10 and 18B-11 of OHP plate wings 42-10 and 42-11, where that heat is rejected to, or absorbed by, the ambient environment on the exterior of the purposed structure 34, thereby efficiently removing heat from heat source(s).

Referring now to FIGS. 1 through 10, in various embodiments the heat source platforms 38 of any of the embodiments exemplarily illustrated in FIGS. 1 through 9C can comprise multi-base heat source platforms 38M that include a primary base 38A1 and one or more secondary base 38A2 extending from the primary base 38A1 at an angle of between 1° and 179°. The secondary base(s) 38A2 can extend from any edge of the primary base 38A1 that does not extend from the respective wing(s) 42 of the respective OHP plate 18. Although FIG. 10 exemplarily illustrates the secondary bases 38A2 implemented with the exemplary embodiments illustrated in FIGS. 7A through 7C, one skilled in the art can readily understand the secondary bases 38A2 can be implemented with any of the embodiments exemplarily illustrated in FIGS. 1 through 9C and described herein. In various instances, the panel 10 can be configured such that the heat source platforms of two or more adjacent OHP plates 18 are multi-base heat source platforms 38M wherein the respective secondary bases 38A2 are disposed in a back-to-back configuration. That is, in such instances, the portion of the second faces 18B of adjacent OHP plates 18 that form the respective secondary bases 38A2 of the respective multi-base heat source platforms 38M are in contact with each other and are not accessible for interfacing with heat sources. In various other instances, the panel 10 can be configured such that the heat source platform of one or more adjacent OHP plate 18 is/are a multi-base heat source platform 38M wherein the respective secondary base(s) 38A2 is/are not disposed adjacent another/other secondary base(s) 38A2 (i.e., are not disposed in a back-to-back configuration with another/other secondary base(s) 38A2). That is, in such instances, the portion of the second faces 18B of the adjacent OHP plates 18 that form the respective secondary base(s) 38A2 of the respective multi-base heat source platforms 38M is/are not in contact with another/other secondary base(s) 38A2 and are accessible for interfacing with heat sources.

All faces or surfaces of the multi-base heat source platforms 38M that are openly exposed (e.g., exposed to the interior of the purposed platform 34) and not in contact with surfaces of other multi-base heat source platforms 38M are accessible for thermally interfacing with one or more heat source. That is, heat sources can be mounted or otherwise thermally connected to any openly exposed face of the multi-base heat source platforms 38M. For example, in the embodiments wherein the heat source platforms of adjacent OHP plates 18 are multi-base heat source platforms 38M and the respective secondary bases 38A2 are disposed in a back-to-back configuration, as described above, the portion of the second faces 18B of the adjacent OHP plates 18 that form the respective secondary bases 38A2 of the respective multi-base heat source platforms 38M are in contact with each other and are not accessible for interfacing with heat sources. However, the portion of the first faces 18A of the adjacent OHP plates 18 that form the respective primary bases 38A1 and secondary bases 38A2 are accessible for interfacing with heat sources, i.e., heat sources can be mounted or otherwise thermally connected thereto.

Conversely, in the embodiments wherein the heat source platform of one or more adjacent OHP plate 18 is/are a multi-base heat source platform 38M and the respective secondary base(s) 38A2 is/are not disposed adjacent another/other secondary base(s) 38A2, as described above, the portion of the second faces 18B of the adjacent OHP plates 18 that form the respective secondary bases 38A2 of the respective multi-base heat source platforms 38M are not in contact with each other and are accessible for interfacing with heat sources, i.e., heat sources can be mounted or otherwise thermally connected thereto. Additionally, the portion of the first faces 18A of the adjacent OHP plates 18 that form the respective primary bases 38A1 and secondary bases 38A2 are accessible for interfacing with heat sources, i.e., heat sources can be mounted or otherwise thermally connected thereto.

Referring now to FIG. 1 through 11, it is envisioned that the OHP plates 18 can be constructed or fabricated such that the wings 42 of any of the embodiments exemplarily described herein can have any desired shape and size. Additionally, it is envisioned that the internal OHP channels 26 of any one or more of the OHP plates 18 exemplarily described herein can have a uniform or non-uniform pattern. For example, as exemplarily illustrated in various figures, the wings 42 can have the shape of a truncated triangle. As exemplarily illustrated in FIG. 11, in such embodiments, the internal channels 26 within the wings 42 can a uniform pattern such that they run substantially parallel with each other, or alternatively internal channels 26 within the wings 42 can have a divergent, or fan-like, pattern.

The description herein is merely exemplary in nature and, thus, variations that do not depart from the gist of that which is described are intended to be within the scope of the teachings. Moreover, although the foregoing descriptions and the associated drawings describe example embodiments in the context of certain example combinations of elements and/or functions, it should be appreciated that different combinations of elements and/or functions can be provided by alternative embodiments without departing from the scope of the disclosure. Such variations and alternative combinations of elements and/or functions are not to be regarded as a departure from the spirit and scope of the teachings.

What is claimed is:

1. A heat rejection panel, said panel comprising:

a chassis having a first side, an opposing second side, and at least one aperture extending therethrough; and at least one oscillating heat pipe (OHP) plate disposed over and in contact with at least a portion of at least one of the first side and the second side of the chassis, the at least one OHP plate comprising a first face, an opposing second face, and a plurality of internal OHP channels, at least one portion of at least one of the first face and the second face of the at least one OHP plate comprises at least one heat source platform that at least one of protrudes into and extends through the at least one aperture in the chassis and is accessible for thermal interfacing with at least one heat source disposed on the at least one heat source platform, and at least one portion of the second face of the at least one OHP plate accessible for thermal interfacing with a heat sink such that the at least one OHP plate will remove heat from the heat source, carry the heat through the at least one aperture in the chassis and spread the removed heat throughout the at least one OHP plate, and reject the heat to the heat sink.

2. The panel of claim 1, wherein the surface area of the at least one portion of the second face of the at least one OHP plate that is accessible for thermal interfacing with a heat sink is equal to or greater than the surface area of the at least one portion of at least one of the first face and the second face of the at least one OHP plate that is accessible for thermal interfacing with at least one heat source.

3. The panel of claim 2, wherein the at least one OHP plate is formed to comprise:

the at least one heat source platform that at least one of protrudes into and extends through the at least one aperture in the chassis such that the at least one portion of at least one of the first face and the second face of the at least one OHP plate that is accessible for thermal interfacing with the at least one heat source is defined by the OHP plate first face of the at least one heat source platform; and at least one heat rejection wing extending from the at least one heat source platform and disposed over the second side of the chassis such that the at least one portion of the second face of the at least one OHP plate that is accessible for thermal interfacing with the heat sink is defined by the OHP plate second face of the at least one wing.

4. The panel of claim 2, wherein the at least one OHP plate comprises at least two OHP plates, wherein each OHP plate formed to comprise:

the at least one heat source platform that at least one of protrudes into and extends through the at least one aperture in the chassis such that the heat source platforms of the at least two OHP plates are stacked on top of each other to define a multi-layered heat source platform that is accessible for thermal interfacing with the at least one heat source, and at least one heat rejection wing extending from the at least one heat source platform and disposed over the second side of the chassis such that the at least one portion of the second face of the at least one OHP plate that is accessible for thermal interfacing with the heat sink is defined by the OHP plate second face of the at least one wing, wherein the at least one wing of each OHP plate extends from the respective at least one heat source platform in a different direction that the at least one wing of the other OHP plates.

5. The panel of claim 4, wherein the at least one heat rejection wing of at least one of the at least two OHP plates has the shape of a truncated triangle and the internal OHP channels are internally formed therein in non-uniform spacing pattern.

6. The panel of claim 4, wherein the internal OHP channels in each of the heat source platforms of the multi-layered heat source platform are fluidly connected with the internal OHP channels of at least one of the other heat source platforms of the multi-layered heat source platform.

7. The panel of claim 2, wherein the at least one OHP plate is formed to comprise:

the at least one heat source platform that extends through the at least one aperture in the chassis and folds over the first side of the chassis such that the at least one portion of at least one of the first face and the second face of the at least one OHP plate that is accessible for thermal interfacing with the at least one heat source is defined by the OHP plate second face of the at least one heat source platform; and at least one heat rejection wing extending from the at least one heat source platform and disposed over the second side of the chassis such that the at least one portion of the second face of the at least one OHP plate that is accessible for thermal interfacing with the heat sink is defined by the OHP plate second face of the at least one wing.

8. The panel of claim 2, wherein the at least one OHP plate comprises at least two OHP plates wherein:

at least one of the at least two OHP plates is formed to comprise the at least one heat source platform that at least one of protrudes into and extends through the at least one aperture in the chassis such that the at least one portion of at least one of the first face and the second face of the at least one OHP plate that is accessible for thermal interfacing with the at least one heat source is defined by the OHP plate first face of the at least one heat source platform;

at least one of the at least two OHP plates is formed to comprise at least one heat source platform that extends through the at least one aperture in the chassis and folds over the first side of the chassis such that the at least one portion of the second face of the at least one OHP plate that is accessible for thermal interfacing with the at least one heat source is defined by the OHP plate second face of the at least one heat source platform; and each OHP plate comprises at least one heat rejection wing extending from the at least one heat source platform and disposed over the second side of the chassis such that the at least one portion of the second face of the at least one OHP plate that is accessible for thermal interfacing with the heat sink is defined by the OHP plate second face of the at least one wing.

9. The panel of claim 2, wherein the at least one OHP plate is formed to comprise:

the at least one heat source platform that extends through the at least one aperture in the chassis and extends away from the first side of the chassis at an angle between 1° and 179° such that the at least one portion of at least one of the first face and the second face of the at least one OHP plate that is accessible for thermal interfacing with the at least one heat source is defined by the OHP plate first face and second face of the at least one heat source platform; and at least one heat rejection wing extending from the at least one heat source platform and disposed over the second side of the chassis such that the at least one portion of the second face of the at least one OHP plate that is accessible for thermal interfacing with the heat sink is defined by the OHP plate second face of the at least one wing.

10. The panel of claim 2 wherein the at least one heat source platform comprises at least one multi-base heat source platform that extends through the at least one aperture in the chassis, the at least one multi-base heat source platform comprising:

a primary base wherein the at least one portion of at least one of the first face and the second face of the at least one OHP plate that is accessible for thermal interfacing with the at least one heat source is defined by the OHP plate first face of the at least one heat source platform primary base; and a secondary base extending from the primary base at an angle between 1° and 1790, wherein the at least one portion of at least one of the first face and the second face of the at least one OHP plate that is accessible for thermal interfacing with the at least one heat source is defined by the OHP plate first face and second face of the at least one heat source platform secondary base; and at least one heat rejection wing extending from the at least one heat source platform primary base and disposed over the second side of the chassis such that the at least one portion of the second face of the at least one OHP plate that is accessible for thermal interfacing with the heat sink is defined by the OHP plate second face of the at least one wing.

11. The panel of claim 1, wherein the OHP plate is fabricated to be a structural support component of the panel such that the OHP panel provides strength and structural integrity to the panel.

12. A structure having an outermost wall that defines an interior space of the structure and separates the interior space from an ambient environment surrounding the structure, wherein at least a portion of the outermost wall comprises at least one heat rejection panel, wherein the at least one heat rejection panel comprises:

a chassis having a first side facing toward the interior of the structure, an opposing second side facing toward the ambient environment, and at least one aperture extending therethrough; and at least one oscillating heat pipe (OHP) plate disposed over and in contact with at least a portion of at least one of the first side and the second side of the chassis, the at least one OHP plate comprising a first face, an opposing second face, and a plurality of internal OHP channels, at least one portion of at least one of the first face and the second face of the at least one OHP plate comprises at least one heat source platform that at least one of protrudes into and extends through the at least one aperture in the chassis and is accessible for thermal interfacing with at least one heat source disposed on the at least one heat source platform and within the interior of the structure, and at least one portion of the second face of the at least one OHP plate accessible for thermal interfacing with the ambient environment such that the at least one OHP plate will remove heat from the heat source, carry the heat through the at least one aperture in the chassis and spread the removed heat throughout the at least one OHP plate, and reject the heat to the ambient environment.

13. The structure of claim 12, wherein the surface area of the at least one portion of the second face of the at least one OHP plate that is accessible for thermal interfacing with ambient environment is equal to or greater than the surface area of the at least one portion of at least one of the first face and the second face of the at least one OHP plate that is accessible for thermal interfacing with at least one heat source.

14. The structure of claim 12, wherein the at least one OHP plate is formed to comprise:

the at least one heat source platform that at least one of protrudes into and extends through the at least one aperture in the chassis such that the at least one portion of at least one of the first face and the second face of the at least one OHP plate that is accessible for thermal interfacing with the at least one heat source is defined by the OHP plate first face of the at least one heat source platform; and at least one heat rejection wing extending from the at least one heat source platform and disposed over the second side of the chassis such that the at least one portion of the second face of the at least one OHP plate that is accessible for thermal interfacing with the ambient environment is defined by the OHP plate second face of the at least one wing.

15. The structure of claim 12, wherein the at least one OHP plate comprises at least two OHP plates, wherein each OHP plate formed to comprise:

the at least one heat source platform of each OHP plate at least one of protrudes into and extends through the at least one aperture in the chassis such that the heat source platforms of the at least two OHP plates are stacked on top of each other to define a multi-layered heat source platform that is accessible for thermal interfacing with the at least one heat source, and the at least one wing of each OHP plate extends from the respective at least one heat source platform in a different direction and is disposed over different sections of the second side of the chassis.

16. The structure of claim 15, wherein the at least one wing of at least one of the at least two OHP plate has the shape of a truncated triangle and the internal OHP channels are internally formed therein in non-uniform spacing pattern.

17. The structure of claim 15, wherein the internal OHP channels in each of the multi-layered heat source platforms are fluidly connected with the internal OHP channels of the other multi-layered heat source platforms.

18. The structure of claim 12, wherein the at least one OHP plate is formed to comprise:

the at least one heat source platform that extends through the at least one aperture in the chassis and folds over the first side of the chassis such that the at least one portion of at least one of the first face and the second face of the at least one OHP plate that is accessible for thermal interfacing with the at least one heat source is defined by the OHP plate second face of the at least one heat source platform; and at least one heat rejection wing extending from the at least one heat source platform and disposed over the second side of the chassis such that the at least one portion of the second face of the at least one OHP plate that is accessible for thermal interfacing with the ambient environment is defined by the OHP plate second face of the at least one wing.

19. The structure of claim 12, wherein the at least one OHP plate comprises at least two OHP plates wherein:

the at least one of the at least two OHP plates comprises at least one heat source platform that at least one of protrudes into and extends through the at least one aperture in the chassis such that the at least one portion of at least one of the first face and the second face of the at least one OHP plate that is accessible for thermal interfacing with the at least one heat source is defined by the OHP plate first face of the at least one heat source platform;

at least one of the at least two OHP plates comprises at least one heat source platform that extends through the at least one aperture in the chassis and folds over the first side of the chassis such that the at least one portion of at least one of the first face and the second face of the at least one OHP plate that is accessible for thermal interfacing with the at least one heat source is defined by the OHP plate second face of the at least one heat source platform; and each OHP plate comprises at least one heat rejection wing extending from the at least one heat source platform and disposed over the second side of the chassis such that the at least one portion of the second face of the at least one OHP plate that is accessible for thermal interfacing with the ambient environment is defined by the OHP plate second face of the at least one wing.

20. The structure of claim 12, wherein the at least one OHP plate is formed to comprise:

the at least one heat source platform that extends through the at least one aperture in the chassis and extends away from the first side of the chassis at an angle between 1° and 179° such that the at least one portion of at least one of the first face and the second face of the at least one OHP plate that is accessible for thermal interfacing with the at least one heat source is defined by the OHP plate first face and second face of the at least one heat source platform; and at least one heat rejection wing extending from the at least one heat source platform and disposed over the second side of the chassis such that the at least one portion of the second face of the at least one OHP plate that is accessible for thermal interfacing with the ambient environment is defined by the OHP plate second face of the at least one wing.

21. The structure of claim 12 wherein the at least one heat source platform comprises at least one multi-base heat source platform that extends through the at least one aperture in the chassis, the at least one multi-base heat source platform comprising:

a primary base wherein the at least one portion of at least one of the first face and the second face of the at least one OHP plate that is accessible for thermal interfacing with the at least one heat source is defined by the OHP plate first face of the at least one heat source platform primary base; and a secondary base extending from the primary base at an angle between 1° and 179°, wherein the at least one portion of at least one of the first face and the second face of the at least one OHP plate that is accessible for thermal interfacing with the at least one heat source is defined by the OHP plate first face and second face of the at least one heat source platform secondary wall; and at least one heat rejection wing extending from the at least one heat source platform primary base and disposed over the second side of the chassis such that the at least one portion of the second face of the at least one OHP plate that is accessible for thermal interfacing with the ambient environment is defined by the OHP plate second face of the at least one wing.

22. The structure of claim 12, wherein the OHP plate is fabricated to be a structural support component of the panel such that the OHP panel provides strength and structural integrity to the panel and the outermost wall.

* * * * *